US005915867A

United States Patent [19]

Hashimoto

[11] Patent Number: 5,915,867

[45] **Date of Patent: *Jun. 29, 1999**

[54] CAPLESS WRITING TOOL

[75] Inventor: Yasuyuki Hashimoto, Hyogo-ken, Japan

[73] Assignee: Ancos Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/653,896

[22] Filed: May 28, 1996

[30] Foreign Application Priority Data

May 26, 1995 [JP] Japan ..... 7-128344
Nov. 10, 1995 [JP] Japan ..... 7-293199

[51] Int. Cl.[6] ..... B43K 9/00

[52] U.S. Cl. ..... 401/108

[58] Field of Search ..... 401/13, 107, 108, 401/99

[56] References Cited

U.S. PATENT DOCUMENTS

| | | | |
|---|---|---|---|
| 1,809,416 | 6/1931 | Liddell | 401/107 |
| 2,957,452 | 10/1960 | Brannon | 401/108 |
| 3,039,436 | 6/1962 | Exner | 401/108 |
| 4,479,732 | 10/1984 | Shimizu | 401/108 X |
| 4,629,348 | 12/1986 | Hashimoto et al. | 401/108 X |
| 4,911,570 | 3/1990 | Rhoades | 401/108 |
| 5,048,990 | 9/1991 | Hashimoto et al. | 401/108 X |
| 5,092,701 | 3/1992 | Lai | 401/108 X |
| 5,207,523 | 5/1993 | Wittek | 401/107 |

FOREIGN PATENT DOCUMENTS

| | | | |
|---|---|---|---|
| 2752304 | 7/1978 | Germany | 401/108 |
| 760452 | 10/1956 | United Kingdom | 401/108 |
| 8502149 | 5/1985 | WIPO | 401/108 |

*Primary Examiner*—William E. Stoll
*Attorney, Agent, or Firm*—Jordan and Hamburg LLP

[57] ABSTRACT

A writing intent has a body tube and a writing member slidably disposed therein, the writing member having a writing end and ink therein. A retraction and advancement mechanism is provide for advancing and retracting the writing member between an operation position and storage position. A sleeve is provided in a front portion of the body and has a scaling cover hinged thereon. The writing member passes through the sleeve and is retractable therein. A mechanism is provided which closes the sealing cover on the sleeve when the writing member is in a retracted position and seals the writing end of the writing member via elastically deformable contact therewith.

23 Claims, 15 Drawing Sheets

CAPLESS WRITING TOOL

BACKGROUND OF THE INVENTION

The present invention relates to a capless writing tool which is so designed that when a writing body is stored, a front end writing portion of the writing body is held in a sealed state by a simple construction and which is suitably used particularly for a ballpoint pen using neutral ink.

A ballpoint pen using gel-like so-called neutral ink whose viscosity is lower than that of oily ink but higher than that of aqueous ink has become popular in recent years for the ink being free from dripping and blurring.

In the case of this neutral ink ballpoint pen, a cap is provided for sealing and protecting the front end writing portion. Such cap, as found in Japanese Utility Model Publication Sho 61-29592 and Japanese Utility Model Kokai Hei 1-139593, has a thick-walled or spherical sealing member of elastic material, such as rubber, so that the front end writing portion of the writing body inserted in the cap elastically abuts against or is slightly embedded in the sealing member, so as to fill the clearance between the writing ball of the front end writing portion and the embracing portion therearound, thereby preventing the drying, leakage and backflow of the ink.

However, the cap type writing tool must have its cap removed each time for writing, the donning and doffing operation being troublesome. Further, the removed cap is liable to be lost. In the case of a sealed cap, when the cap is put on the main body of the writing tool, the pressure in the cap increases, resulting in the air entering the writing body through a slight clearance between the writing ball and the embracing portion therearound; thus, it is also necessary to provide air circulation means in the cap itself.

Therefore, in the case of this neutral ink ballpoint pen also, it is desired to provide a capless writing tool which can dispense with the cap, which allows the front end writing portion to go in and out by a knocking operation, and which has a mechanism for preventing the drying, leakage and backflow of the ink.

In recent years, among capless writing tools adapted to project the front end writing portion at a touch as by a knock, there has appeared one provided with a mechanism for preventing the drying of the ink in the writing body.

As for a capless writing tool having this drying preventing mechanism, various suggestions have been made; for example, as found in Japanese Patent Kokai Hei 4-14880, Japanese Patent Kokai Hei 5-68360 and Japanese Utility Model Kokai Hei 2-112492, there is proposed one comprising an openable and closable seal cover installed on the front end of a seal sleeve disposed in the main body, the arrangement being such that the seal cover is opened and closed by the advancing and retracting action of the writing body through a string-like member installed to extend between the seal cover and the writing body.

The proposed mechanism is so designed that in the state in which the front end writing portion of the writing body is received in the seal sleeve, sealing is effected at two longitudinally spaced locations, one on the seal cover at the front end and the other on a seal portion, such as a circumferential ridge, closely contacting the outer periphery of the writing body disposed rearwardly of an air hole, thereby isolating the interior of the seal sleeve from the outside so as to maintain the sealed state. Thus, in a writing tool, such as a pad type aqueous ink ballpoint pen having an air hole in the vicinity of the front end writing portion, or a pad type aqueous or oily marker, the front end writing portion, together with the air hole, is maintained in the completely sealed state to prevent the drying of the ink.

In the case of the proposed drying preventing mechanism, however, the two seal portions complicate the sealing mechanism and, furthermore, since the clearance between the writing ball and the embracing portion therearound is not closed, it cannot be said to be in a sealed state, having almost no effect in preventing the drying, leakage and backflow of the ink.

That is, in the case of a neutral ink ballpoint pen, a rear end of the writing body is not in the completely sealed state and instead it is charged with gel-like fluid sealant which differs in specific gravity from ink and which is viscous and has fluidity, so as to prevent backflow of the ink and allow a decrease in the amount of ink, thereby enabling the pen to be used without any trouble even if the rear end of the writing body is open while dispensing with the air hole in the vicinity of the front end writing portion.

Therefore, up to now there has been no neutral ink ballpoint pen put into practical use which is capless and which can be made ready for writing by the knocking operation.

SUMMARY OF THE INVENTION

Accordingly, the present invention is intended to provide a capless writing tool applicable to a neutral ink ballpoint pen and capable of reliably holding in a sealed state a front end writing portion in which a writing ball is embraced to partly project therethrough, particularly a capless writing tool so designed that the clearance between the ball in the front end writing portion and an embracing portion therearound is maintained in the sealed state by direct contact of a seal cover therewith which is opened and closed by being longitudinally moved under an advancing and retracing action, thereby ensuring prevention of the drying, leakage and backflow of the ink, allowing the advancing and retracting operation by knocking or by rotation to be effected without any trouble.

Further, in the case of such a capless writing tool, there is the fear of the seal cover being closed before the writing body enters the main body, depending upon a difference in strength between a pulling spring for holding the seal cover in the closed state and a retracting spring for the writing body. Therefore, giving consideration to this point also, the invention provides a capless writing tool having consideration given thereto such that a guide sleeve having the seal cover will not be retracted too much when the writing body is stored.

To solve the above-mentioned problem, a capless writing tool is provided comprising a main body having a hole in a front end, a writing body stored in the main body and having a front end writing portion adapted to go in and out through the hole, a sleeve which is disposed in a front portion of the main body and through which at least a front portion of said writing body passes, a cover for the sleeve, means for holding the cover in a closed state and in an opened state, and means for maintaining the sealed state such that the front end writing portion of the writing body elastically embeddedly contacts the cover when the latter is in the closed state.

A capless writing tool as described above is also provided wherein when the cover is opened, the sleeve has already been relatively advanced with respect to the writing body and hence the front end writing portion is no longer in close contact with the cover.

A capless writing tool as described above is also provided wherein when the cover is closed, the sleeve has already been relatively retracted with respect to the writing body and hence the front end writing portion is no longer in close contact with the cover.

A capless writing tool is also provided wherein received in the main body having a hole through which the front end portion of a writing body goes in and out is the writing body having a front end writing portion embracing a writing ball, a seal cover made, at least at its inner surface, of elastic material is operably and closably installed in the vicinity of the front end of the guide sleeve, the tool including an advancing and retracting mechanism for advancing the writing body to hold the latter in the writing state and retracting it to bring it into the stored state, and connecting means which, when the writing body is stored by the advancing and retracting mechanism, pulls the seal cover to hold it in the closed state and which, when the writing body is advanced, lessens the pulling to cancel the closed state of the seal, the seal cover in the closed state being elastically closely contacted with the front end writing portion of the writing body 3 to the extent of filling the clearance between the writing ball and the ball embracing portion therearound so as to maintain the sealed state.

A capless writing tool as described above is also provided wherein the guide sleeve having the seal cover is longitudinally movable but prevented from advancing beyond a given limit, and a slackable string-like member serving as pulling means is installed to extend between the seal cover and a slide ring rearwardly urged by a spring, the arrangement being such that when the writing body is advanced by the advancing and retracting mechanism, the guide sleeve, together with the slide ring, slightly moves in the advancing direction to cancel the sealed state of the front end writing portion established by the seal cover, and then the pulling means slacks with the advance of the writing body, thereby opening the seal cover.

A capless writing tool as described above is also provided wherein received in the main body having a hole through which the front end portion of a writing body goes in and out is the writing body having a front end writing portion embracing a writing ball, and there is provided an advancing and retracting mechanism for advancing the writing body against the urging force of a retracting spring so as to hold it in the writing state and retracting it for storage, installed in the front portion of the main body is a guide sleeve through which the front portion of the writing body can pass, the guide sleeve being longitudinally movable as it is urged in the advancing direction but being prevented from advancing or retracting beyond a given limit, and installed in the vicinity of the front end of the guide sleeve is a seal cover which is made, at least at its inner surface, of elastic material and which is urged in the opening direction, a slide ring rearwardly urged by a pulling spring is installed such that when the writing body is advanced by the advancing and retracting mechanism, the slide ring is pushed slightly earlier than the writing body, there being installed to extend between the slide ring and the seal cover a slackable string-like member which pulls the seal cover when the writing body is stored, the seal cover elastically closely contacting the front end writing portion of the writing body to the extent of filling the clearance between the writing ball and the ball embracing portion therearound so as to maintain the seal state, the arrangement being such that when the writing body is advanced, the guide sleeve, together with the slide ring, slightly advances to cancel the sealed state of the front end writing portion established by the seal cover and then the string-like member slacks with the advance of the slide ring, allowing the seal cover to assume the opened state and advancing the writing body to be ready for writing.

According to the invention as described above there is further provided a capless writing tool having a locking portion engageable by the slide ring which is retracting and is provided on the outer periphery of the writing body such that in the stored state there is a slight clearance between it and the rear surface of the slide ring, and in the operation for retraction the slide ring is retracted to a position little short of its storage position.

According to the invention there is also provided the capless writing tool arranged in the manner described in the preceding paragraph wherein the elastic force of the retracting spring is equal to or somewhat greater than that of the pulling spring, and means is provided for urging the guide sleeve in the advancing direction by an elastic force which is lower than the elastic force of each of the springs.

According to the invention as described above there is also provided a capless writing tool wherein the means for urging the guide sleeve in the advancing direction is a separating spring whose elastic force is much less than that of each of the retracting and pulling springs.

The invention as described above also provides a capless writing tool wherein the means for urging the guide sleeve in the advancing direction is a rubber sleeve in the form of a bellows.

The invention as described above further provides a capless writing tool wherein the longitudinally movable guide sleeve is provided with a first stop, such as a flange, step or projection, which is located rearwardly of the locking ring on the main body and which, when the writing body is advanced, abuts against the rear end surface of the locking ring, and a second stop, such as a flange, step or projection, which is located forwardly of the locking ring and which, when the writing body is stored, abuts against the front end surface of the locking ring.

As for the applicable scope of the invention, the invention is not limited to a neutral ink ballpoint pen but is applicable to other writing tools in as wide a range as covered by the essence of the present invention, including oily ink ballpoint pens, pad type aqueous ink ballpoint pens, pad type aqueous and oily markers, felt-tip pens, and so on. That is, it is applicable to writing tools in general capable of having the cover closely contacted with the front end of the writing tool in order to prevent the drying, leakage and backflow of the ink.

According to the capless writing tool of the invention, since the front end writing portion is held in the sealed state, the drying, leakage and backflow of the ink is effectively prevented.

According to the capless writing tool of the present invention, when the cover is opened, the cover has already been relatively retracted with respect to the writing body, and hence the front end writing portion is no longer in contact with the cover; therefore, there is no possibility of the front end writing portion and the cover rubbing hard against each other, thus contributing to the protection of the front end writing portion.

According to the capless writing tool of the present invention, when the cover is closed, the writing body has already been relatively retracted with respect to the sleeve; therefore, there is no possibility of the front end writing portion and the cover rubbing hard against each other, thus, in this case also, contributing to the protection of the front end writing portion.

According to the capless writing tool of the present invention, in the state where the front end writing portion is stored in the main body, the seal cover of elastic material is pulled by connecting until it is held in the closed state crossing the axis of the main body, and the writing body is elastically contacted, at its front end writing portion, with the inner surface of the seal cover of elastic material in such a manner as to elastically deform the seal cover to fill the clearance between the writing ball and the embracing portion therearound Thereby, the clearance around the ball of the front end writing portion is maintained in the completely sealed state, so that the drying, leakage and backflow of the ink from the front end writing portion can be prevented. In addition, in the case of a neutral ink ballpoint pen, since a fluid sealant is charged rearwardly of the ink, even if the rear end is opened, there is no fear of the drying, leakage and backflow of the ink.

To make ready for writing, when the slide ring is advanced through the advancing and retracting mechanism, the pulling means slacks to release the seal cover from the closed state. Then, when the writing body, together with the slide ring, are advanced by the advancing and retracting mechanism, the seal cover opens and the writing body has its front end writing portion projected through the hole in the front end of the main body to be ready for writing.

In the storing operation, after completion of writing, when the writing body is retracted through the advancing and retracting mechanism, the pulling means is held slack to maintain the state in which the seal cover is open, until the front end writing portion is retracted to the predetermined position opposed to the seal cover. After the front end writing portion is retracted rearwardly of the predetermined position, the pulling means acts on the seal cover so that with the retraction of the writing body, the seal cover is pulled in the closing direction, with its inner surface elastically abutting against the front end writing portion. When the writing body reaches its storage position, the seal cover is suitably elastically pressed against the front end writing portion, thereby holding the latter in the sealed state.

For example, in the case where the guide sleeve is longitudinally movable but prevented from advancing beyond a given limit and a slackable string-like member serving as pulling means is installed to extend between the seal cover and a slide ring rearwardly urged by a spring, the arrangement is such that when the writing body is advanced for writing by the advancing and retracting mechanism, the guide sleeve, attending the advancing movement of the slide ring, slightly advances prior to the movement of the writing body, allowing the seal cover to release the front end writing portion from its seal. Thereafter, the writing body starts to advance while the pulling means slacks to open the seal cover. Therefore, there is no possibility of the front end writing portion strongly rubbing the inner surface of the seal cover. In the storing operation of the writing body, in reverse of the above, first the writing body returns to the predetermined position and after the seal cover is separated from the front end writing portion by the pulling means to assume the closed state at the separated position, the inner surface of the seal cover elastically deforms against the front end writing portion, thus elastically closely embeddedly contacting the front end writing portion. Thereby, the clearance between the ball of the front end writing portion and the embracing portion therearound is completely sealed.

According to the capless writing tool of the present invention, in the state in which the front end writing portion of the writing body is stored in the main body, the seal cover of elastic material, together with the guide sleeve, is pulled by the slide ring through the string-like member and held in the closed state crossing the axis of the main body. The writing body elastically closely contacts, at its front end writing portion, the inner surface of the seal cover while elastically deforming the latter to fill the clearance between the writing ball and the embracing portion therearound. Thereby, the clearance between the writing ball of the front end writing portion and the periphery around the ball is held in the completely sealed state, so that the drying, leakage and backflow of the ink is prevented.

Then, to establish the writing state, the writing body is operated to advance by the advancing and retracting mechanism. During this advancing operation, the slide ring is pushed slightly earlier than the writing body. This slight initial advance of the slide ring slacks the pulling string-like member, so that the guide sleeve, together with the slide ring, urged in the advancing direction is slightly advanced to cancel the sealed state of the front end writing portion established by the seal cover.

Thereafter, when the writing body, together with the slide ring, starts to advance, the string-like member further slacks to allow the seal cover, urged in the opening direction, to open. After the seal cover has opened, the writing body alone advances until the front end writing portion projects through the hole in the front end of the main body and is held ready for writing.

When the writing body is operated for storage by the advancing and retracting mechanism, the writing body and the slide ring are retracted by the elastic force of the retracting spring and the urging force of the pulling spring, respectively, both returning to the storage state.

Particularly in the case of a feature of the invention described above, since a locking portion engageable by the slide ring which is retracting is provided on the outer periphery of the writing body, the writing body is positively retracted until it is close to the storage position as it is pushed not only by the elastic force of the retracting spring but also by the retracting action of the slide ring. In the vicinity of the storage position, the slide ring is disengaged from the locking portion and returns under the force of the retracting spring alone to the predetermined storage position.

Further, during this retraction of the slide ring and writing body, the seal cover is held in the open state as long as the pulling string-like member remains slack. As the string-like member becomes gradually tightened, the seal cover is pulled to assume the closed state, when, however, the writing body has already been considerably retracted, so that the seal cover is closed without any trouble. Furthermore, after it is closed, the guide sleeve is moved in the retracting direction and inner surface of the seal cover elastically contacts the front end writing portion of the writing body which is in the storage position while elastically deforming to have the front end writing portion embedded therein. Thereby, the clearance between the ball of the front end writing portion and the embracing portion therearound is completely sealed.

In the case of a feature of the invention described above, since the elastic force of the retracting spring is equal to or somewhat greater than that of the pulling spring, the writing body is returned substantially concurrently with or somewhat earlier than the slide ring. Therefore, when the string-like member is tightened by the retraction of the slide ring to pull the seal cover to its closed position, the writing body is already in the considerably retracted position, so that the seal cover is closed without any trouble.

Furthermore, since elastic force of the separating spring urging the guide sleeve in the advancing direction is lower than that of the pulling spring, after it has been closed as described above, the guide sleeve is moved in the retracting direction against the urging force of the pulling spring as the string-like member is pulled by the slide ring which is retracting under the urging force of the pulling spring; thus, the inner surface of the seal cover elastically closely embeddedly contacts the front end writing portion of the writing body in the storage position and is held in the predetermined closely contacted state.

In the case of the invention of claim 9, with the locking ring on the main body forming a boundary, the separating spring is installed separate from the retracting and pulling springs; thus, the elastic force of the separating spring is set at a much lower value than that of each of the other two springs, thereby advancing the guide sleeve.

Further, according to a feature of the present invention, the separating spring in the invention described above is replaced by a rubber sleeve in the form of a bellows to urge the guide sleeve in the advancing direction. The guide sleeve is advanced by a distance allowed by the rubber sleeve being slightly stretched.

In the writing tool of the present invention, during the advance of the writing body, after the guide sleeve has slightly advanced, the seal cover starts to open; thus, it is possible to prevent the seal cover from continuing to retract after the front end of the writing body has been embedded in the inner surface of the seal cover.

DETAILED DESCRIPTION OF THE INVENTION

Figure 1A:
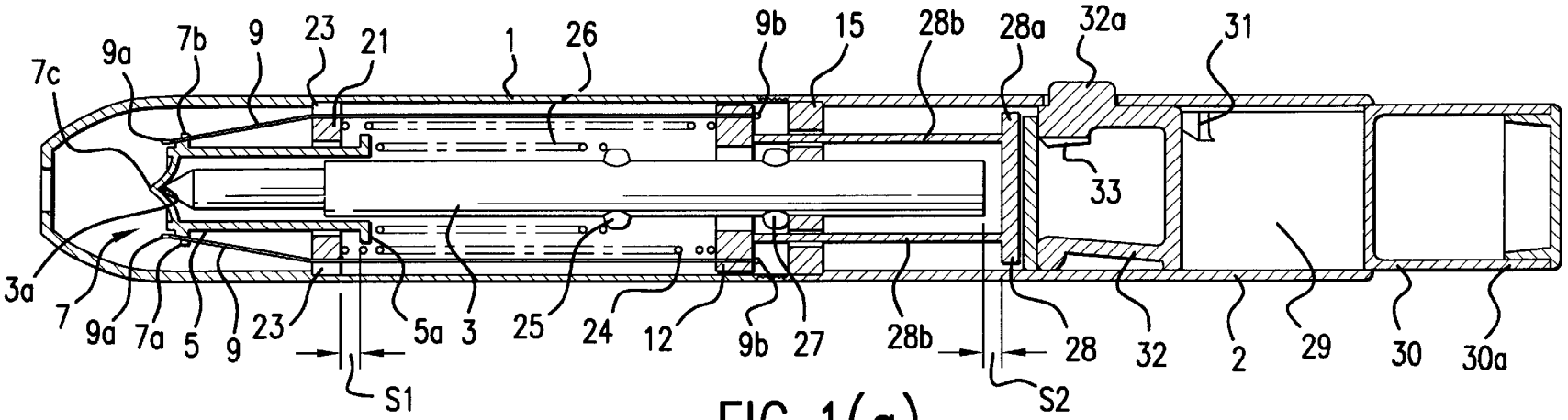
FIGS. 1(*a*) and 1(*b*) are, respectively, a sectional view (a) and a side sectional view (b), showing a stored state of the writing body of a writing tool of an embodiment of the invention.
Figure 1B:
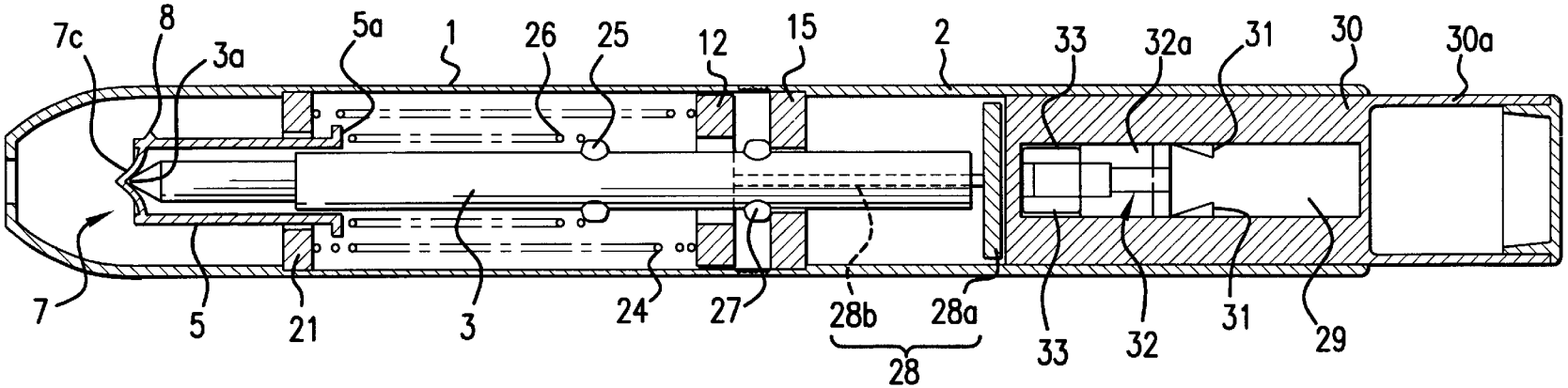

FIG. 1(*a*) is a sectional view of a writing tool (ballpoint pen) showing an embodiment of the present invention, and FIG. 1(*b*) is a side sectional view with the writing tool shown in a position turned through 90 degrees from the position shown in FIG. 1(*a*), both views showing the sealed state of the writing body stored in the main body.

In the figures, 1 denotes a front shaft, and 2 denotes a rear shaft, both shafts being threadedly fitted together in a unit, forming the main body of the writing tool. The front shaft 1 has at its front end a hole through which a front end portion of writing body goes in and out. The numeral 3 denotes the writing body of a neutral ballpoint pen and has a front end writing portion 3*a* which rotatably embraces at its tapered front end a writing ball in its partly projecting state (about 30–40% of the ball diameter).

The writing body 3 has neutral ink charged therein and has a fluid sealant (not shown) charged therein adjacent the rear terminal end for preventing backflow of the ink.

A guide sleeve 5 having a seal cover 7 is formed separate from a locking ring of larger diameter abutting against a step portion formed in the front shaft 1 so that it will not move further forward therebeyond. The guide sleeve 5 is longitudinally movably inserted in the locking ring 21 and has a flange portion 5*a* formed on the rear end thereof, the flange portion 5*a* being adapted to come in locking engagement with the locking ring 21 so as to prevent forward movement beyond a given limit.

Figure 2:
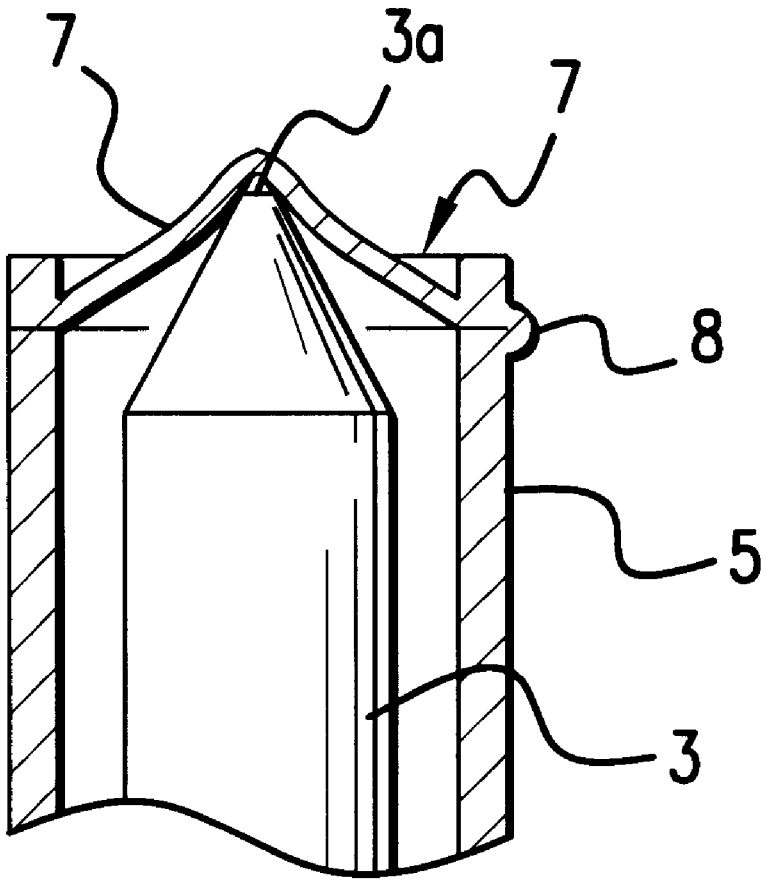
FIG. 2 is a principal enlarged sectional view of a seal cover in FIG. 1(*a*).

The seal cover 7 connected for opening and closing movement to the guide sleeve 5 through a hinge portion 8 may be in the form of a thick plate of elastic material having a spherically bulged inner surface; in this embodiment, however, as shown enlarged in FIG. 2 it is in the form of a relatively rigid frame internally integrally formed with a cover plate portion 7*c* which can be elastically deformed into a substantially conical shape when the front end writing portion 3*a* of the writing body 3 abuts it. The cover plate portion 7*c* may be formed as a separate portion which is then attached to the frame.

Two lobes 7*a*, 7*b* formed on the seal cover 7 have joined thereto one of respective ends of string-like members 9, 9 serving as pulling means. The string-like members 9, 9 extend rearward through guide grooves 23, 23 formed in an outer periphery of the locking ring 21 and are joined to a slide ring 12 axially slidably disposed in the front shaft 1. As for the means for joining the string-like members 9, 9 to the seal cover 7 and slide ring 12, various means may be utilized, such as one comprising cuts in the two lobes 7*a*, 7*b* and ball-like stops 9*a*, 9*a* formed on the front ends of the string-like members 9, whereby locking is effected. In the figures, 9*b*, 9*b* denote ball-like stops formed on the rear ends of the string-like members.

A sealing spring 24 is interposed between the slide ring 12 and locking ring 21, urging the slide ring 12 rearward, thereby making it possible to pull the seal cover 7 by the string-like members 9, 9. In addition, the slide ring 12 does not engage the writing body 3 and is adapted to be moved without operative connection with the writing body 3.

Formed on an outer periphery of the writing body 3 is a locking portion 25 in the form of a projection or the like integrally formed, at a position forward of the slide ring, and fixed in position as by crimping or pressure-fitting, and a separating spring 26 which also serves to restore the writing body 3 is interposed between the locking portion 25 and the flange 5*a* on the rear end of the guide sleeve 5, whereby the writing body 3 is urged rearward.

The separating spring 26 is lower in elastic force than the sealing spring 24; therefore, when the writing body 3 is in its normal storage position, the urging force exerted by the spring 24 pulls the string-like members 9, 9 to hold the seal cover 7 in the closed state abutting against the guide sleeve 5, while, as shown in FIG. 1, the guide sleeve 5 is pulled against the elastic force of the spring 26 until the flange portion 5*a* has a slight spacing S1 between it and the locking ring 21.

Figure 3A:
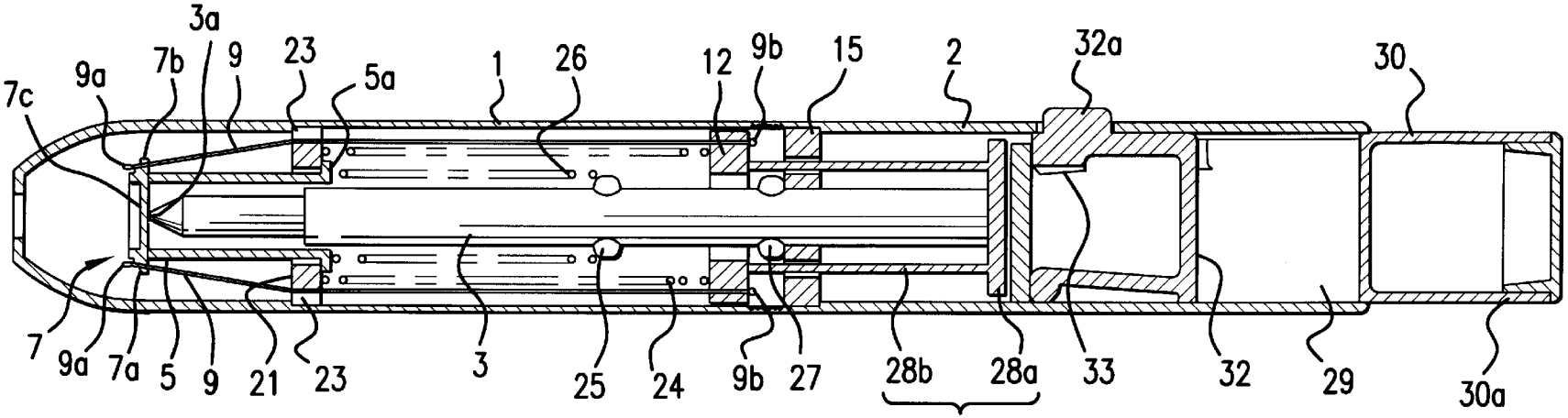
FIGS. 3(*a*) and 3(*b*) are, respectively, a sectional view (a) and a partial side sectional view (b), showing the seal cover and a front end writing portion being released from pressing against each other.
Figure 3B:
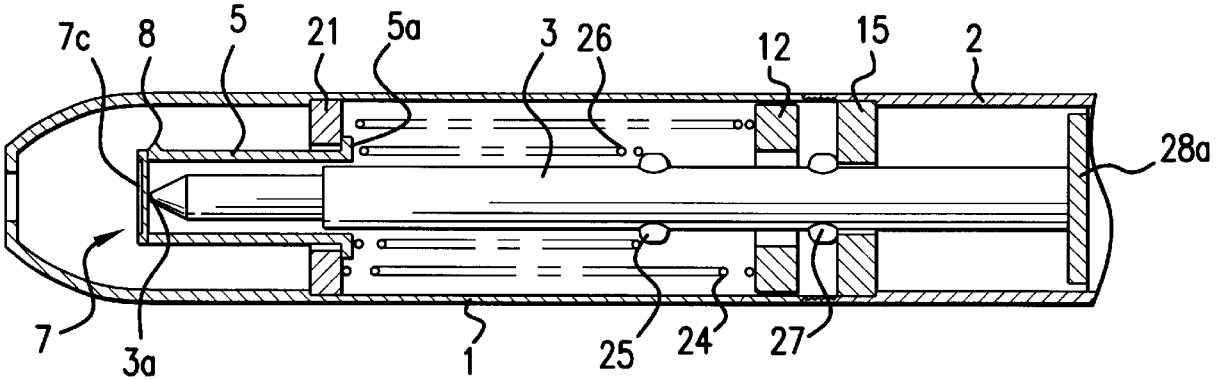

To this end, the spacing S1 is set such that the guide sleeve 5 and the string-like members 9, 9, in the state in which the flange portion 5*a* abuts against the locking ring 21 and is thereby locked, the seal 7, while abutting against the guide sleeve 5, either lightly contacts the front end writing body 3*a* of the writing body 3 in the storage position or is slightly separated therefrom shown in FIG. 3.

Therefore, in the normal stored state of the writing body 3, as shown in FIG. 1, the flange portion 5*a* of the guide sleeve 5 is held away from the locking flange 21, thereby making it possible for the cover portion 7*c* of the seal cover 7 to elastically deform into a conical shape elastically contacting the front end writing portion 3*a* as if wrapping the latter, so that the clearance between the writing ball and the embracing portion therearound can be thoroughly sealed.

The rear portion of the writing body 3 is so arranged that the rear locking portion 27 abuts against a stop ring 15 fitted in the rear shaft 27, thus allowing no further retraction.

The numeral 28 denotes a pushing member axially movably disposed behind the stop ring 15 in the rear shaft 2. The pushing member 28 has rods 28*b*, 28*b* projecting therefrom and disposed at a plurality of opposed places thereon in the vicinity of an outer periphery of a circular plate 28*a*, rods being capable of extending through the stop ring 15 to push the slide ring 12.

The pushing member 28 is held with the rods 28*b*, 28*b* always abutting against the slide ring 12, and when the writing body 3 is in the normal stored state (the state shown in FIG. 1), there is a spacing S2 defined between the circular plate 28*a* and a rear end of the writing body 23 and corresponding to the spacing S1 between the locking ring 21 and flange portion 5*a*. When the pusher member 28 is advanced, it abuts against the rear end of the writing body 3 and pushes the latter.

Therefore, as the pushing member 28 is advanced by an advancing and retracting mechanism, it somewhat pushes the slide ring 12 by the rods 28*b*, 28*b* and then pushes the writing body 3 by the circular plate 28*a*.

Further, in this embodiment, as an advancing and retracting mechanism there is inserted in the rear shaft 2, disposed rearwardly of the pushing member 28, a pusher 30 having an elongated opening 29 which opens on the opposite sides, one end 30*a* thereof serving as a knocking portion adapted to project rearwardly through the rear shaft 2. This elongated hole 29 determines a slide stroke of the pusher 30 itself and is provided at one opening with inwardly directed locking projections 31, 31 on an inner wall at a substantially longitudinally middle portion. Disposed in the elongated hole 29 is a substantially U-shaped operating member 32 of elastic material, and a push button portion 32*a*, which is a portion thereof, slightly projects laterally through a through-hole formed in the rear shaft 2, whereby the operating member is unrotatably fitted to the main body. Further, there are horizontally projecting wing portions 33, 33 which integrally project from widthwise opposite sides of the push button portion 32*a*.

According to this advancing and retracting mechanism, giving a knock on the projecting end 30*a* of the pusher 30 causes the locking projections 31, 31 to move while elastically downwardly deforming the push button portion 32*a* through the wing portions 33, 33, also causing the pushing member 28 to push the slide ring 12 and writing body 3. When the projections 31, 31 move past the push button portion 32*a*, the push button portion 32*a* is restored to the original state by the repulsive force exerted between it and the other side and is held in locking engagement with the projections 31, 31, and when the push button portion 32*a* is pushed, it is restored to the original state by the springs 26 and 24 urging the writing body 3 and slide ring 12.

In the case of this embodiment, in the normal stored state of the writing body 3, since the elastic force of the spring 24 is greater than that of the spring 26, this results in the state shown in FIG. 1 in which the slide ring 12 is in its rearmost position, with the string-like members 9, 9 pulling the seal cover 7 to hold the latter in the closed state, and rearwardly displacing the guide sleeve 5 against the urging force of the spring 26, with the seal cover 7 elastically deformed into a substantially conical shape against the front end wiring portion 3*a* to contact the latter, so that the clearance between the ball of the front end writing portion 3*a* and the embracing portion therearound is held in the sealed state.

When a knock is given on the pushing bar 30 to advance the pushing member 28 in order to establish the writing state, first, the slide ring 12 is pushed by the rods 28*b*, 28*b* of the pushing member 28 to make a forward movement. This movement slackens the string-like members 9, 9 and at the same time, guide sleeve 5 moves forward, prior to the movement of the writing body 3, under the urging force of the spring 26 until the flange portion 5*a* makes locking engagement with the ring 21; thus, as shown in FIG. 3, the seal cover 7 either lightly contacts the front end writing portion 3*a* or is slightly separated therefrom.

Figure 4A:
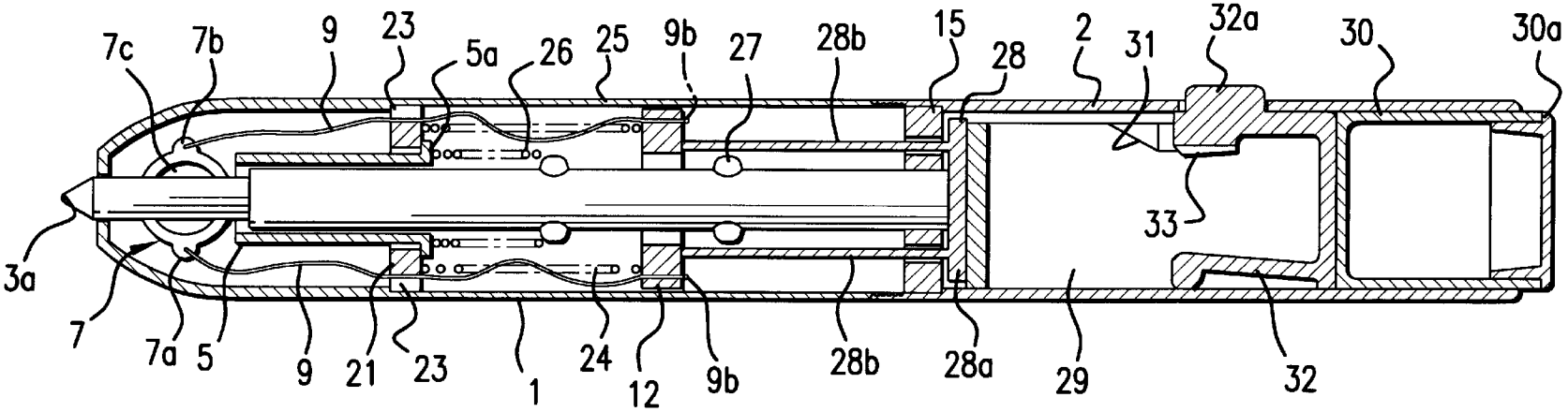
FIGS. 4(*a*) and 4(*b*) are, respectively, a sectional view (a) and a partial side sectional view (b), showing a writing state of the front end writing portion of the writing body being projected.
Figure 4B:
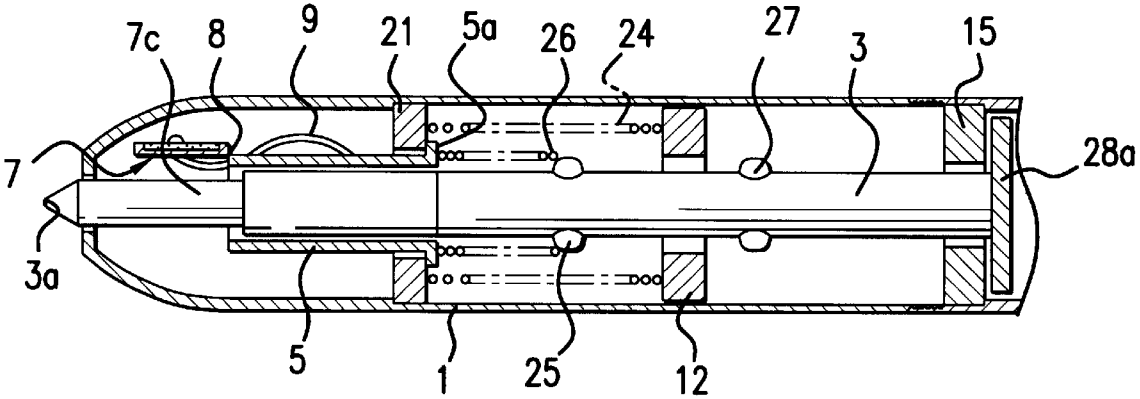

Thereafter, the forward movement of the pushing member 28 causes the circular plate 28*a* to abut against the rear end of the writing body 3 to advance the latter and the slide ring 12. Thereby, the string-like members 9, 9 slack and in the case where the seal cover 7 is urged in the opening direction, it opens under the urging force and even in the case where it is not urged, it also opens as it is pushed by the front end writing portion 3*a* of the writing body 3; in this case there is no possibility of the front end writing portion 3*a* strongly rubbing the inner surface of the seal cover 7. After the seal cover 7 has been fully opened, the writing body 3 further advances with the string-like members 9, 9 slackened, until the front end writing portion 3*a* projects through the hole in the front end of the front shaft 1, as shown in FIGS. 4 (*a*), (*b*); thus, it is held ready for writing.

Further, when the writing body 3 is operated for storage, the push button portion 32*a* of the operating member 32 projects laterally from the main body, whereby the pushing action provided by the pushing member 28 is cancelled, so that the writing body 3 is returned to its storage position by the urging force of the spring 26, while the slide ring 12 is also returned to its rearmost position by the urging force of the spring 24. At this time, contrary to the above, first the writing body is returned to the predetermined position and the seal cover 7 is pulled by the string-like members 9, 9 to assume the state of FIG. 3, and then the guide sleeve 5 is moved rearward wrapping the front end writing portion 3*a*. This means that the clearance between the ball of the front end writing portion 3*a* and the embracing portion therearound is thoroughly sealed.

Figure 5:
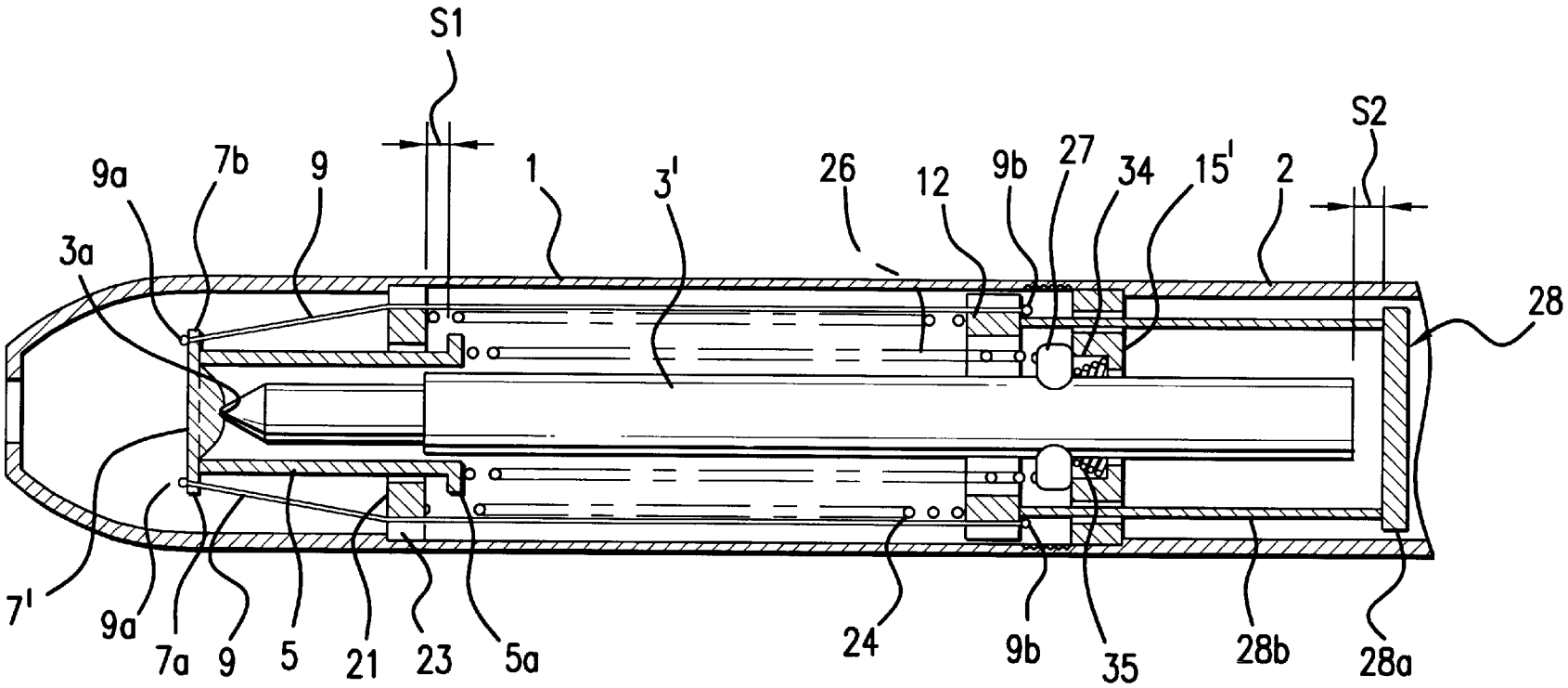
FIG. 5 is a partial sectional view showing a modification of the embodiment of FIGS. 1(*a*) and (*b*).

FIG. 5 shows a modification of the above embodiment.

In the modification, a seal cover 7' is a spherically bulged elastic body and one of the locking portions on the outer periphery of the writing body 3 is omitted and instead the spring 26 for returning a writing body 3' is extended through the hole in the slide ring 12 to be interposed between the rear locking portion 27 in locking engagement with a stop ring 15' and the flange portion 5*a* of the guide sleeve 5*a*.

Further, the stop ring 15' has a hole of increased diameter in the front surface to form a step portion, on which a spring 35 of lower elastic force than the spring 26 is installed so as to elastically store the rear locking portion 27 to absorb the shock when the portion 27 abuts against the stop ring 15' during the return movement of the writing body 3' from its projecting state. The rest of the arrangement is the same as in FIGS. 1–4.

In this modification also, in the normal stored state of the writing body 3', there is a spacing S2 defined between the rear end of the writing body 3' and the pushing member 28 and corresponding to the spacing S1 between the locking ring 21 and the flange portion 5*a;* thus, the front end writing portion 3*a* of the writing body 3' elastically abuts against the inner surface of the seal cover 7' and is thereby held partly embedded as illustrated, and the pushing action of the pushing member 28 caused by the advancing and retracting mechanism produces the same two-step effect as in the preceding embodiment, so that the seal cover 7' either lightly contacts the front end writing portion 3*a* or is slightly separated therefrom and then the writing body 3' is advanced and the seal cover 7' is opened.

When the writing body 3' is restored to its original stored state, the spring 35 elastically stores the rear locking portion 27 to absorb the shock produced when it abuts against the stop ring 15', thereby preventing backflow of the fluid sealant or ink. In addition, this shock absorbing means using the spring 35 is also applicable to the embodiment of FIG. 1 or may be replaced by other shock absorbing means.

In the case where the seal cover 7' itself has a sufficient elastic restoring force, the separating spring 26 may be omitted.

As for the advancing and retracting mechanism, use may be made of other knocking mechanisms, such as known rotary cam mechanisms, or rotary type mechanisms which relatively rotate the front and rear shafts.

Figure 6A:
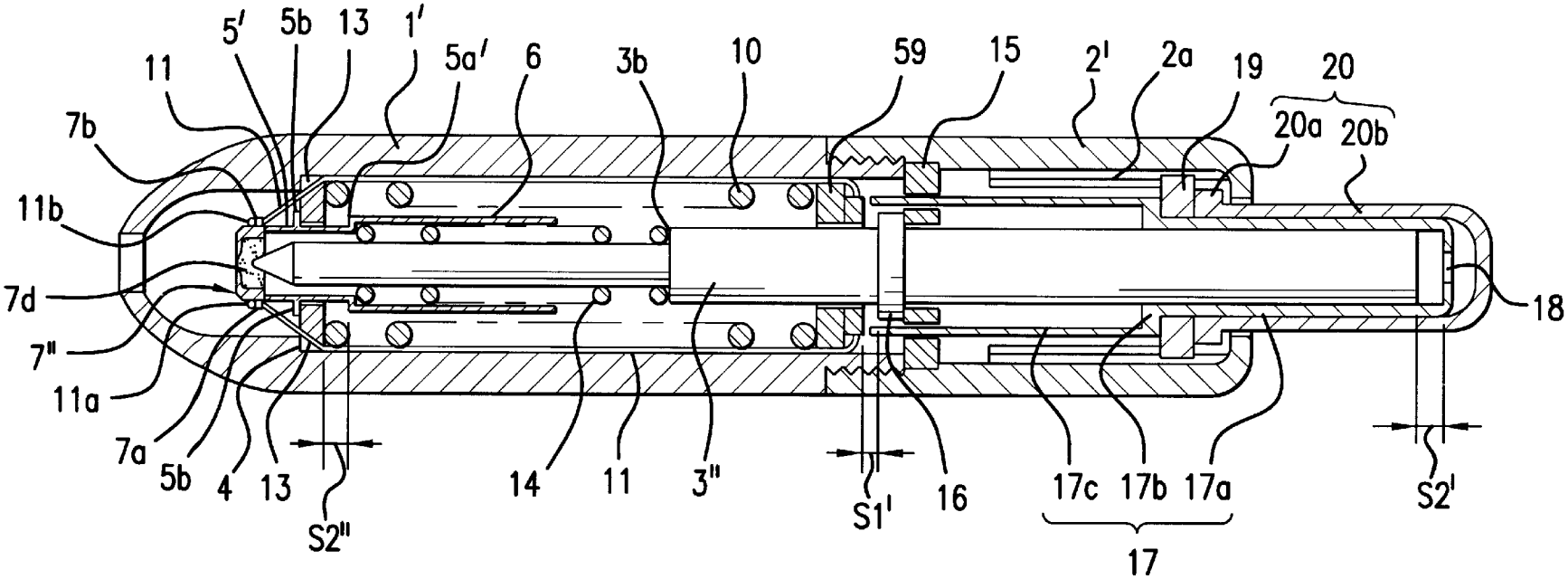
FIGS. 6(*a*) and 6(*b*) are, respectively, a sectional view (a) and a side sectional view (b), showing the stored state of the writing body of a writing tool of another embodiment of the invention.
Figure 6B:
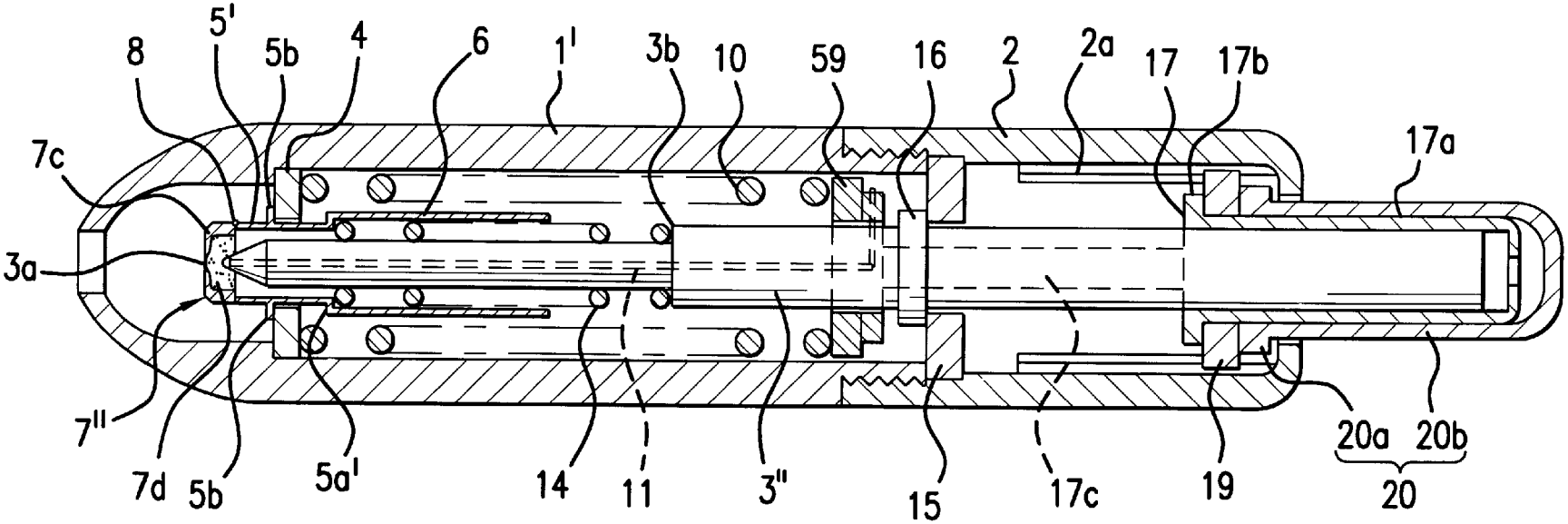

FIG. 6(*a*) is a sectional view of a writing tool (ballpoint pen) showing another embodiment of the invention and FIG. 6(*b*) is a side sectional view with the state of FIG. 6(*a*) turned through 90 degrees, both figures showing a sealed state in which the writing body is stored in the main body.

In the figures, the numeral 1' denotes a front shaft, and 2' denotes a rear shaft having a cam wall 2*a* in the rear portion, the two shafts being threadedly fitted together in a unit, forming the main body for the writing tool. The front shaft 1' has at its front end a hole through which the front end portion of the writing body goes in and out. The numeral 3" denotes the writing body of a ballpoint pen, the writing body 3" having a front end writing portion 3*a* which, at its tapered front end, rotatably embraces a writing ball in its partly projecting state (about 30–40% of the ball diameter). The writing body 3" has neutral ink charged therein and has a fluid sealant (not shown) charged therein adjacent the rear terminal end for preventing backflow of the ink.

The numeral 4 denotes a locking ring urged by pressing means or the like to abut against a step portion in the front shaft 1' so as to be prevented from moving any further therebeyond forwardly or rearwardly.

The numeral 5' denotes a guide sleeve 5' which is disposed in the front shaft 1' and through which the writing body 3" is movable, the guide sleeve 5' being longitudinally movably inserted through the locking ring 4 and having a step portion 5*a'* of hook-shaped cross section in a rear end thereof which is adapted to come into locking engagement with the locking ring 4, thereby preventing its forward movement beyond a given limit. In the normal stored state, the front end portion of the writing body 3" is held in the guide sleeve 5'. In the illustrated case, the guide sleeve 5' is integrally formed with an auxiliary sleeve 6 of somewhat greater diameter which receives a writing body retracting spring, to be later described, through the step portion 5*a*.

A seal cover 7" having two lobes 7*a,* 7*b* at opposed positions on the peripheral edge is connected to an edge of the guide sleeve 5' adjacent the front end thereof through a hinge 8, the seal cover 7" being urged in the opening direction so that it can be opened and closed between a closed position where it is substantially orthogonal to the axis of the front shaft 1' and an opened position where it rises to assume a position which is substantially parallel with the axis.

Figure 7:
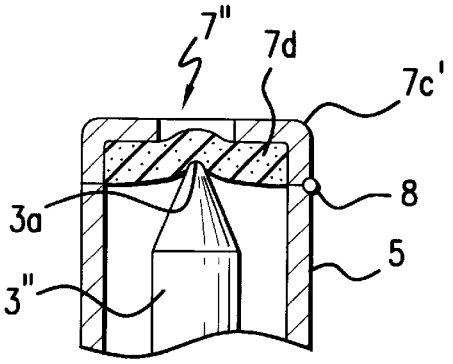
FIG. 7 is an enlarged sectional view of the seal cover portion shown in FIGS. 6(*a*) and 6(*b*).

The seal cover 7" is formed, at least on its inner surface, of an elastic material, such as rubber, and it is arranged that, as shown enlarged in FIG. 7, when the front end writing portion 3*a* of the writing body 3" abuts against the seal cover 7", the latter elastically sufficiently deforms for elastic intimate contact therewith to the extent of filling the clearance between the writing ball of the front end writing portion 3*a* and the embracing portion therearound.

That is, the diameter of the writing ball of the ballpoint pen is usually 0.3–0.5 mm, and its projecting dimension is 0.1–0.2 mm or thereabouts. Therefore, if the seal cover 7" is an elastic body having sufficient elasticity for the front end writing portion 3*a* abutting against the seal cover 7" to be covered deeper, e.g., 0.4 mm or more, than the projecting dimension of the ball, then the clearance between the ball and the embracing portion it therearound can be filled.

To this end, the seal cover 7" in the illustrated embodiment, as shown enlarged in FIG. 7, comprises a dish-shaped frame dish portion 7*c'* having a central opening and made of a metallic material, such as stainless steel, or synthetic resin or other elastic material, and an elastic body 7*d* of silicone rubber or the like having elasticity to deform when the front end writing portion 3*a* of the writing body 3" abuts it, the elastic body 7*d* being easily inseparably attached to the inner side of the frame dish portion 7*c'* by bonding or fitting means.

Besides this, other arrangements are possible in which the seal cover 7" is elastically deformable to the extent that it seals the front end writing portion 3*a;* for example an arrangement in which the seal cover 7" itself is formed of an elastic body having a spherically bulged inner surface or is a thick plate, and another in which bonded to the inner surface of a plate-like seal cover 7" made of rigid material is an elastic body of rubber or the like.

The numeral 59 denotes a slide ring which is disposed for axial sliding movement in the front shaft 1' and through which the rear portion of the writing body 3" extends. A pulling spring 10 is interposed between the slide ring 59 and the locking ring 4, whereby the slide ring 59 is always urged rearward.

Installed between the slide ring 59 and the seal cover 7" is a slackable string-like member 11 for pulling the seal cover 7" during the storage of the writing body 3". Thus, in the normal stored state of the writing body 3", the seal cover 7" is rearwardly pulled by the urging force of the spring 10 via the string-like member 11 and held in the closed state abutting against the front end of the guide sleeve 5'. The string-like member 11 is made of a material which negligibly elongates or contracts with regard to temperature and moisture and which resists friction and tension, for example monofilament yarn of synthetic resin, and is thin and capable of slacking to a suitable degree.

Figure 9:
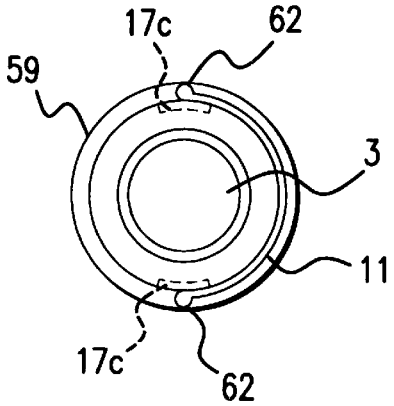
FIG. 9 is a back side view of a slide ring.

As means for laying the string-like member 11, in the illustrated case, use is made of a single string-like member, whose middle portion is entrained around an outer periphery of a smaller diameter portion on a back of the slide ring 59, as shown in FIG. 9, and whose opposite end portions are passed through string passage holes 62 at opposed positions on the slide ring 59 and extend forward in parallel with the axis of the main body and then through guide grooves 13, 13 formed in the outer periphery of the locking ring 4 and are connected to the two lobes 7*a*, 7*b* of the seal cover 7".

Figure 8:
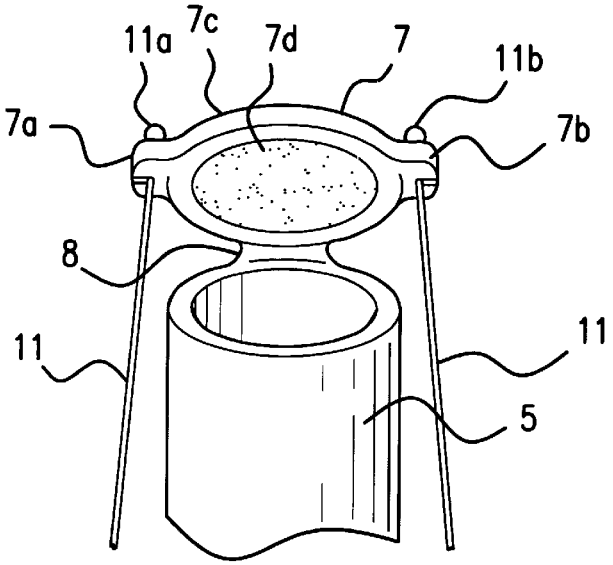
FIG. 8 is a partial enlarged perspective view showing a somewhat opened state of the seal cover.

As means for connecting the opposite ends of the string-like member 11 to the seal cover 7", as shown in FIG. 8, the lobes 7*a*, 7*b* are formed with cuts and the string-like member 11 having ball-like stops 11*a*, 11*b* at its ends is passed in the cuts and locked therein, whereby it is connected. Of course, other connecting means may be used to connect the ends of the string-like member 11 to the lobes 7*a*, 7*b*. Further, another arrangement may be made wherein two string-like members are installed by connecting their respective opposite ends to the lobes 7*a*, 7*b* of the seal cover 7" and to the slide ring 59. However, from the standpoint of making uniform the tension on the string-like member 11 and from the standpoint of accommodating variations in the lengths of two string-like members, it is preferable to use a single string-like members as described above. The string-like member may be entrained around the seal cover 7" and then the ball-like stops on its ends may be connected to the slide ring.

The numeral 14 denotes the spring for retracting the writing member 3", which, in the illustrated case, is received in the auxiliary sleeve 6 and interposed between the step portion 3*b* of the smaller diameter end of the writing body 3" and the step portion 5*a'* of the rear end of the guide sleeve 5'. This retracting spring 14 also serves as a separating spring which urges the writing body 3" always rearward.

The rear end portion of the writing body 3" extends rearward through the stop ring 15 fitted in the rear shaft 2'. A locking portion 16, in the form of a ridge or the like, is installed on the outer periphery of the writing body 3" by crimping or press-fitting, the arrangement being such that when the locking portion 16 abuts against the stop ring 15, further retraction is prevented. Thereby, the storage position of the writing body 3" is determined.

The retraction preventing locking portion 16 also serves as an engaging portion adapted to engage the slide ring 59 when the latter is retracted, thereby making it possible for the slide ring 59 to retract the writing body 3" during the operation for retracting the writing body 3". From the standpoint of mitigating the shock during the operation for retraction, it is desirable that the locking portion 16 be positioned such that in the stored state of the writing body 3" shown in FIG. 6, there is a slight spacing S1' between it and the rear surface of the slide ring 59.

In addition, for the locking portion to be engaged by the slide ring 59, it is also possible to provide another locking portion such as a ridge or step on the outer periphery of the writing body 3", separate from the retraction preventing locking portion 16.

The retracting spring 14 has lower elastic force than the pulling spring 10 and hence when the writing body 34" is in said storage position, the urging force of the pulling spring 10 holds the seal cover 7" in the closed state in which it abuts against the guide sleeve 5' with the string-like member 11 being in a tight state. And as shown in FIG. 6, the guide sleeve 5' is pulled against the elastic force of the retracting spring 14, which also serves as a separating spring, and the front end writing portion 3*a* is elastically pressed against the inner surface of the seal cover 7" and held in intimate contact therewith. At this time, there is a slight spacing S2' between the step portion of the rear end of the guide sleeve 5' and the locking ring 4.

In order to avoid the situation in which the urging force of the retracting spring 10 acts so hard during the retraction of the slide ring 59 as to cause the guide sleeve 5' to retract in the locking ring 4 too much, a washer 5*b* is sometimes installed on the outer periphery of the guide sleeve 5' positioned to abut against the locking ring 4 in the state shown in FIG. 6. This washer 5*b* may be replaced by one to three projections.

In this case, the locking ring 4, guide sleeve 5' having the seal cover 7", spring 10, slide ring 59, and string-like member 11 are assembled outside before the locking ring 4 is pressed into the front shaft 1'; therefore, it is possible to provide the step portion 5*a'* and the washer 5*b* with the locking ring 4 disposed therebetween.

Figure 10:
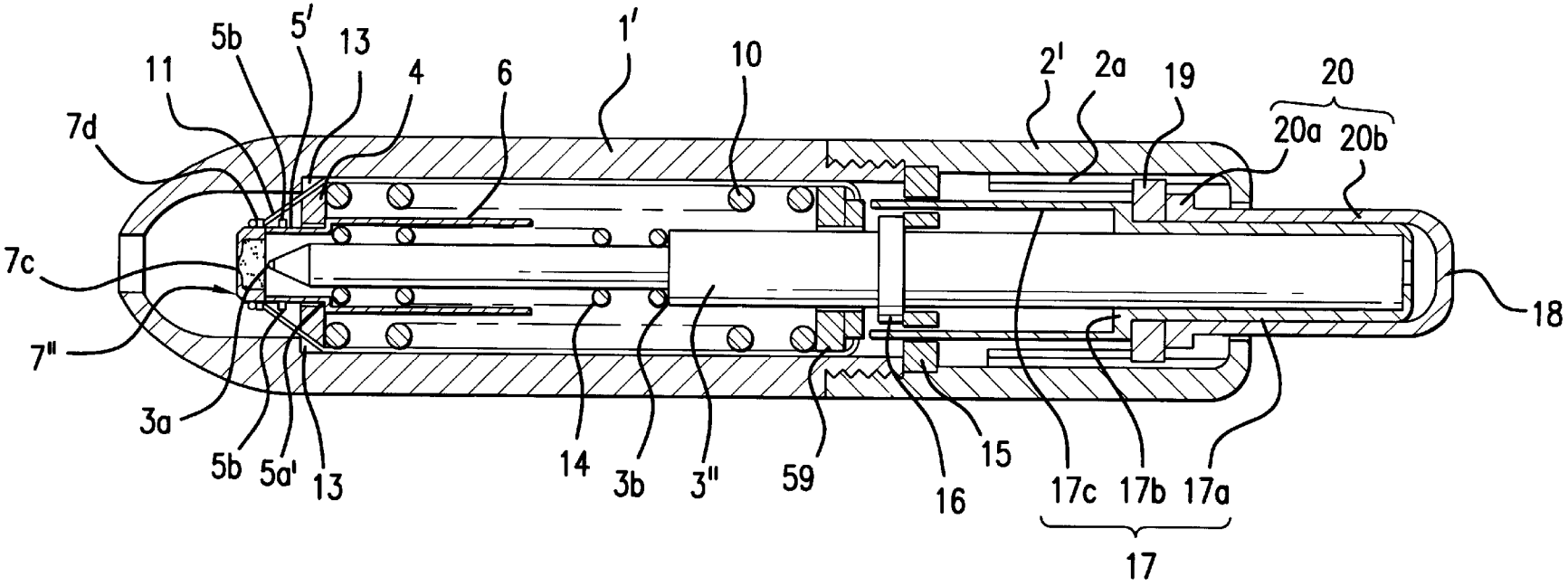
FIG. 10 is a sectional view showing the front end writing portion released from the seal provided by the seal cover.

The spacing S2" is such that when the step portion 5*a'* is in locking engagement with the locking ring 4, the seal cover 7", while being held abutting against the guide sleeve 5' and closed, either lightly contacts the front end writing portion 3*a* of the writing body 3" placed its storage position or is slightly separated therefrom (the state shown in FIG. 10).

The numeral 17 denotes a pushing member axially movable rearward from the stop ring 15 in the rear shaft 2'. This pushing member 17 comprises a sleeve portion 17*a* having the rear portion of the writing body 3" slidably fitted therein, and a rod or rods 17*c* projecting therefrom at one place or at a plurality of opposed places on a front end flange 17*b* of the sleeve portion 17*a*, as illustrated, the rods 17*c* extending through the stop ring 15 forwardly to push the slide ring 59.

The pushing member 17 is positioned such that when the front ends of the rods 17*c* are substantially abutting against the slide ring 59 and the writing body 3" is in the normal stored state (the state shown in FIG. 6), there is a spacing S2' between a bottom of the sleeve portion 17*a* and a rear end of the writing body 3", corresponding to the spacing S2" between the step portion 5*a* of the guide sleeve 5' and the locking ring 4, it being arranged that after the spacing S2' has been disappeared under the advancing action of the pushing member 17, the bottom abuts against the rear end of the writing body 3" to push the latter.

Therefore, the pushing member 17, under the advancing action of the advancing and retracting mechanism, first, somewhat pushes the slide ring 59 by the rods 17*c*, and then pushes the writing body 3" by the bottom of the sleeve portion 17*a*. The numeral 18 denotes an air circulation hole formed in the bottom of the sleeve portion 17*a*.

Further, in this embodiment, the advancing and retracting mechanism comprises a rotary cam 19 adapted to abut against and engage the flange portion 17*b* and a bottomed sleeve-like pusher 20 fitted on the sleeve portion 17*a* of the pushing member 17. The pusher 20 has a cam surface on a front surface of the front end larger diameter portion 20*a* for rotating the rotary cam 19, and a rear portion 20*b* projecting from a rear end of the main body is a knocking bar. Thereby, a known rotary cam mechanism is constructed; thus, giving a knock on the pusher 20 causes the writing body 3" to advance and lock and the next knock causes the writing body 3" to be restored to its original stored state under the elastic force of the spring 14. This is the same as in the action given by the known rotary cam mechanism, and a detailed illustration and description thereof is omitted.

In addition, there is a slight clearance between the rear end of the larger diameter portion 20*a* of the pusher 20 and the flange portion in the rear end of the rear shaft 2'; the purpose is to accommodate a slight elongation of the string-like member 11.

How to operate the writing tool of this embodiment will now be described. In the normal stored state of the writing body 3" shown in FIG. 6, since the elastic force of the pulling spring 10 is greater than that of the retracting spring 14, the slide ring 59 assumes its rearmost position and the string-like member 11 pulls the seal cover 7" to hold the latter in the closed state while displacing the guide sleeve 5' rearward against the urging force of the spring 14, with the seal cover 7" being elastically deformed into a substantially conical shape intimately contacting the front end writing portion 3*a,* the clearance between the ball in the front end writing portion 3*a* and the embracing portion therearound being held in the sealed state.

When a knock is given on the pusher 20 to advance the pushing member 17 in order to establish the writing state, first, the slide ring 59 is pushed to advance by the pushing member 17. As soon as this movement slackens the string-like member 11, the guide sleeve 5' is moved forward by the urging force of the spring 14 prior to the movement of the writing body 3", until the step portion 5*a'* comes in locking engagement with the locking ring 4, with the result that as shown in FIG. 10, the seal cover 7" either slightly contacts the front end writing portion 3*a* or is slightly separated therefrom.

Figure 11:
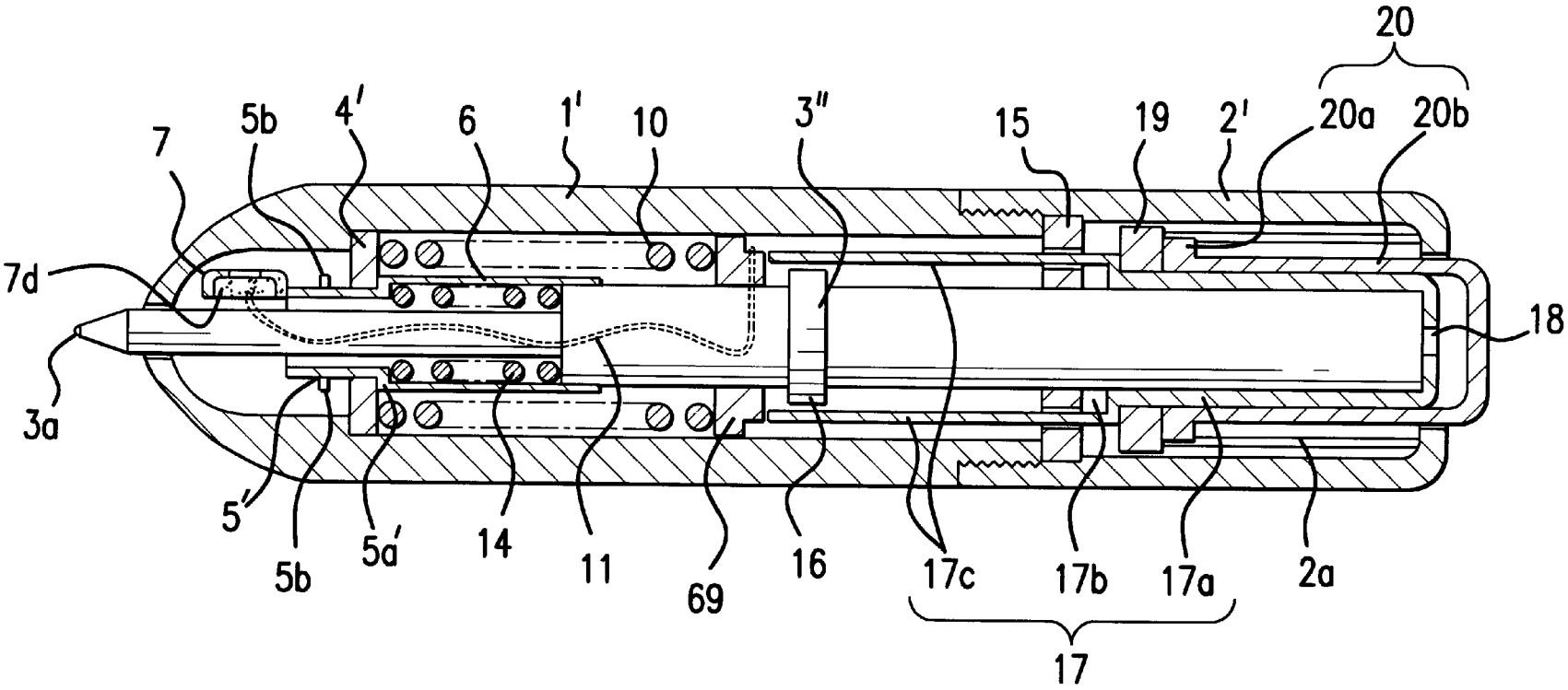
FIG. 11 is a side sectional view showing the projecting state of the front end writing portion of the writing body.

Thereafter, the forward movement of the pushing member 17 causes the bottom of the sleeve portion 17*a* to abut against the rear end of the writing body 3" to move the latter, together with the slide ring 59. Thereby, the string-like member 11 slacks and the seal cover 7" opens under the urging force thereon. There is no danger of the front end writing portion 3*a* rubbing hard against the inner surface of the seal cover 7". After the seal cover 7" is fully opened, the writing body 3" further advances with the string-like member 11 slackened, until the front end writing portion 3*a* projects through the hole in the front end of the front shaft 1', as shown for the embodiment in FIG. 11, to be ready for writing.

When it is desired to store the writing body 3", a knock is given on the pusher 20, whereupon the writing body 3" and the slide ring 59 are retracted by the elastic force of the retracting spring 14 and the urging force of the pulling spring 10, respectively. At this time, even if the retraction of the slide ring 59 is too fast, the engagement of the slide ring 59 with the locking portion 16 ensures that the writing body 3" is pushed by the retracting action of the slide ring 59 and is positively retracted until it is close to the storage position. Furthermore, when it comes close to the storage position, the slide ring 59 is released from the locking portion 16, so that the writing body 3" returns to the predetermined storage position by the action of the retracting spring 14 alone and hence there is no heavy shock applied thereto.

Further, the retraction of the slide ring 59 tightens the string-like member 11, pulling the seal cover 7" to its closed state, when the writing body 3" to be retracted as described above is already in the considerably retracted position, so that the seal cover 7 can be closed without interference. Furthermore, after it has been closed, the guide sleeve 5' is moved in the retracting direction and the seal cover 7" abuts against the front end writing portion 3*a* of the writing body 3", with the elastic body 7*d* elastically deforming to embed the front end writing portion 3*a* for elastic intimate contact therewith. Thereby, the front end writing portion 3*a* is held in the sealed state.

In this embodiment, a rotary cam mechanism has been shown as an example of the advancing and retracting mechanism for the writing body 3". However, knocking type, rotary type or other type of advancing and retracting mechanism may be used.

A further embodiment of the present invention will now be described with reference to FIGS. 12–15.

Figure 12A:
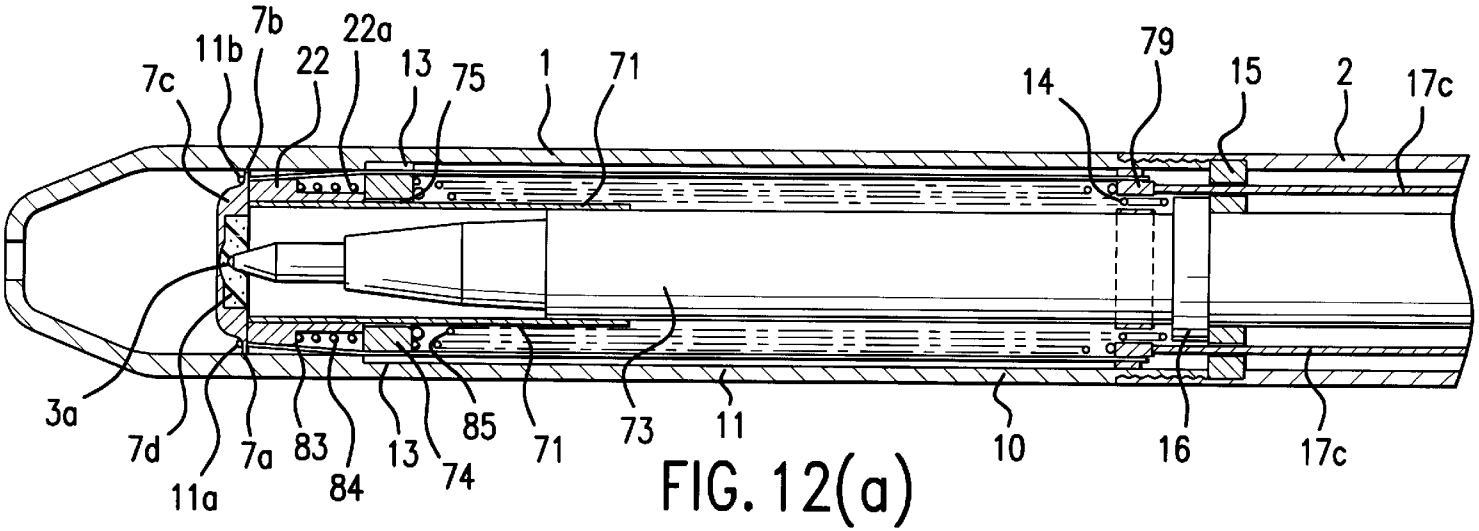
FIGS. 12(*a*) and 12(*b*) are, respectively, a partial sectional view (a) and a side sectional view (b), showing the stored state of the writing body of a writing tool showing yet another embodiment of the invention.
Figure 12B:
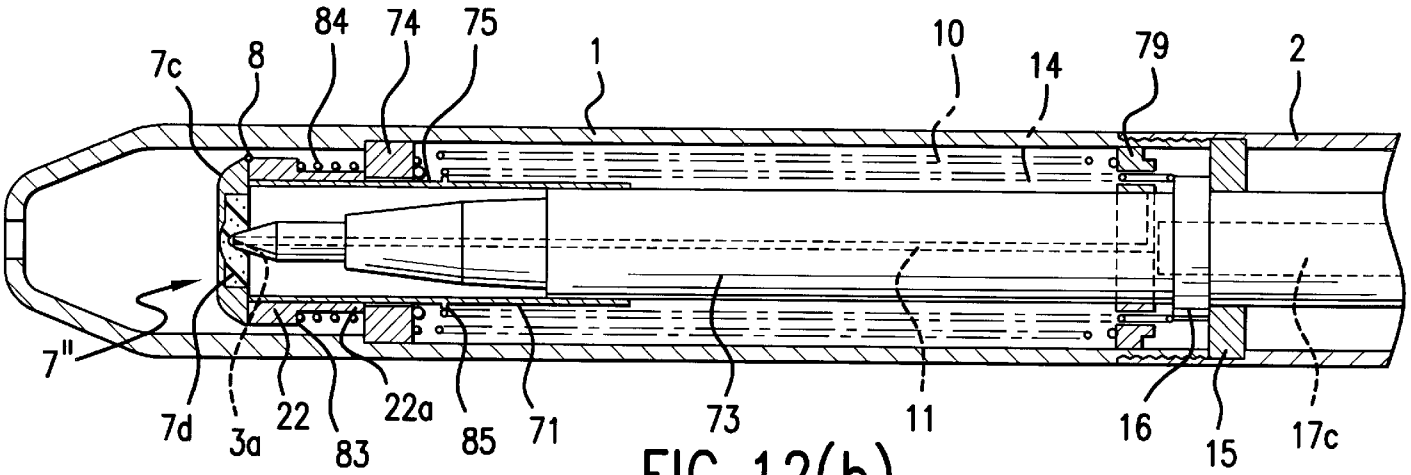

FIG. 12(*a*) is a sectional view of a writing tool and FIG. 12(*b*) is a side sectional view taken at a position to which the state of FIG. 12(*a*) is turned through 90 degrees, both views showing the sealed state where a writing body 73 is stored in the main body. The portions corresponding to those in the embodiments shown in FIGS. 6–11 are given the same reference characters.

In this embodiment, a locking ring 74 longitudinally movably engages a guide sleeve 75 and a cover forming member 22 having a seal cover 7" connected thereto is fixed to the front end of a sleeve 71 which is capable of extending through the front portion of the writing body 73. A step portion 83 is formed, and a separating spring 84 urges the guide sleeve 5 in the advancing direction and is interposed between the step portion 23 and the locking ring 74. Further, a ridge 85 is adapted to engage the locking ring 74 and is formed on the outer periphery of the sleeve 71 rearwardly of the locking ring 74 so as to prevent the guide sleeve 75 from advancing beyond a given limit. In addition, it is also possible to form the cover forming member 22 integrally with the sleeve 71 and likewise the form step portion 83. The rear portion of the cover forming member 22 is a smaller diameter portion 22*a*.

The seal cover 7", as in the case of the first embodiment, has an elastic body 7*d* attached to the inner side of a frame dish 7*c'* of rigid material; however, various other forms may be used which are adapted to elastically abut against the front end writing portion of the writing body 73 to perform the sealing function. A string-like member 11 is tightly installed by the same means as in the preceding embodiment between the seal cover 7" and the slide ring 79 which is axially slidably installed in the front shaft 1. The pulling spring 10 for urging the slide ring 79 rearward is interposed between the slide ring 79 and the locking ring 74, making it possible to pull the seal cover 7". This point is the same as in the first embodiment.

The retracting spring 14 for urging the writing body 73 rearward is interposed between the locking portion 16, such as a crimp, installed on the outer periphery of the writing body 73 and the locking ring 74, and it is arranged that when the locking portion 16 abuts against the stop ring 15 fitted in the rear shaft 2, any further retraction of the writing body 3 is prevented.

Particularly, in the case of this embodiment, the elastic force of the retracting spring 14 is equal to or somewhat greater than that of the pulling spring 10 for urging the slide ring 79 rearward.

Figure 13:
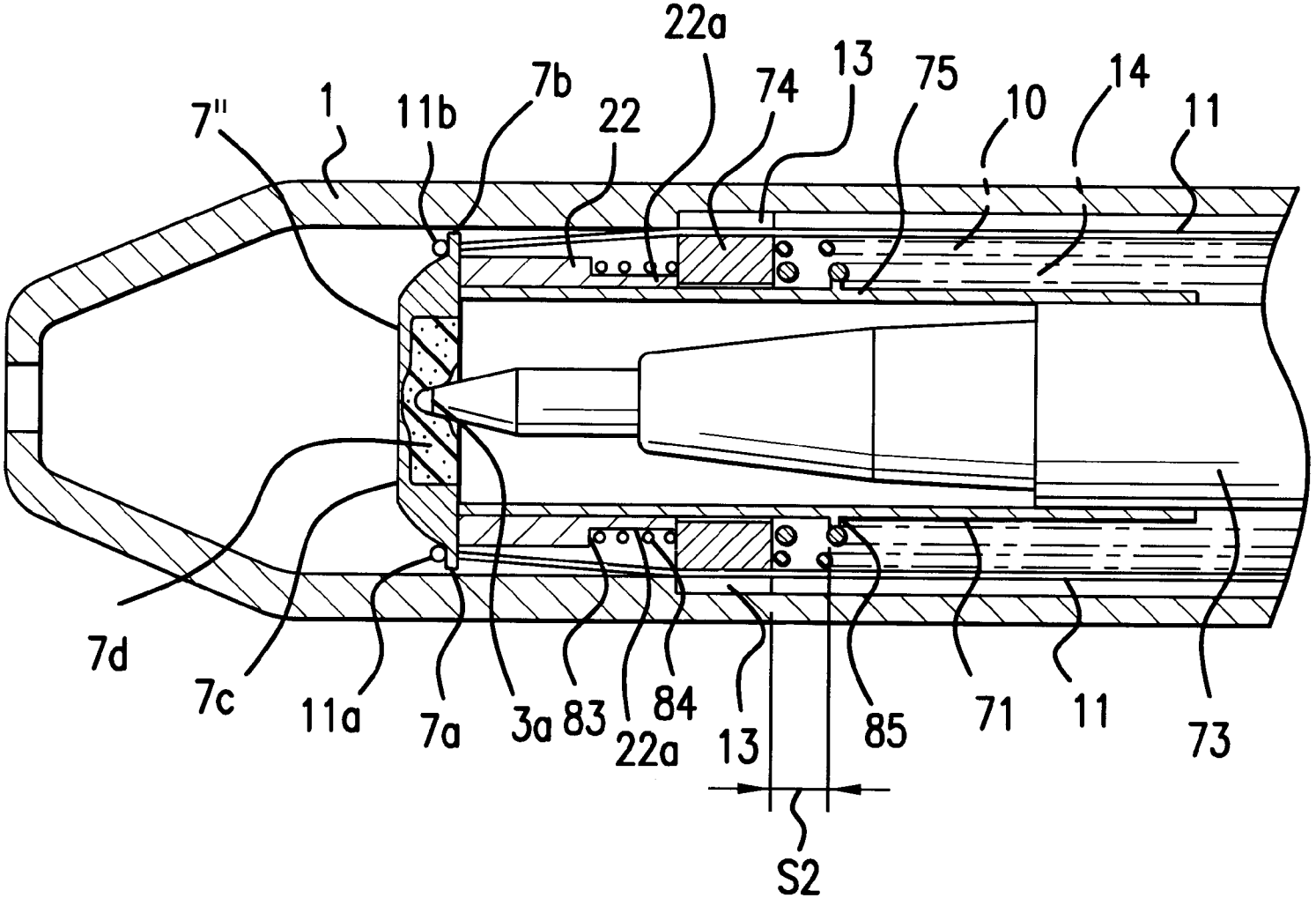
FIG. 13 is an enlarged sectional view of the front portion of the preceding FIG. 12(*b*).

Further, a separating spring 84 has a lower elastic force than the two springs 10 and 14. Thereby, when the writing body 73 is in the normal storage position, the seal cover 7" is pulled to abut against the slide sleeve 75 and held in the closed state by the urging force of the pulling spring 10 through the string-like member 11. And as shown in FIG. 13, the guide sleeve 75 is pulled against the elastic force of the separating spring 84 and the ridge 85 on the guide sleeve 75 is positioned away from the locking ring 74. Further, the spacing S2" between the locking ring 84 and the ridge 85 is such that when the ridge 85 abuts against the locking ring 84, the seal cover 7" is held in the closed state and lightly contacts the front end writing portion 3*a* of the writing body 73 in the storage position or assumes the FIG. 14 position where it is slightly separated therefrom.

Therefore, in this embodiment also, when the writing body 3 is in the normal stored state, as shown in FIG. 12, the ridge 85 of the guide sleeve 75 is held away from the locking ring 84, whereby the elastic body 7*d* of the seal cover 7" elastically deforms into a conical shape elastically closely contacting the front end writing portion 3*a* as if to wrap the latter, thereby completely sealing the clearance between the writing ball and the embracing portion therearound.

In addition, since the advancing and retracting mechanism for the writing body 73 can be embodied basically in the same manner as in the first embodiment, a detailed illustration and description thereof are omitted. The forward movement produced through the advancing and retracting mechanism causes the pushing rod 17*c* extending through the stop ring 15 to push the slide ring 79 forward and also causes the bottom (not shown) of the pushing member to advance the writing body 3.

In this embodiment also, in the normal stored state of the writing body 73, the slide ring 79 is in its rearmost position and the seal cover 7" is pulled through the string-like member 11 and held in the closed state. And since the elastic force of the separating spring 84 is less than that of the pulling spring 10, the guide sleeve 75 is in the FIG. 12 state as it is rearwardly displaced against the urging force of the separating spring 84. The seal cover 7" is elastically deformed into close contact with the front end writing portion 3*a,* and the clearance between the ball of the front end writing portion 3*a* and the embracing portion therearound is held in the sealed state. At this time, the rear end of the rear smaller diameter portion 22*a* of the cover forming portion 22 contacts the locking ring 74 to prevent any further retraction of the seal cover 7.

Figure 14:
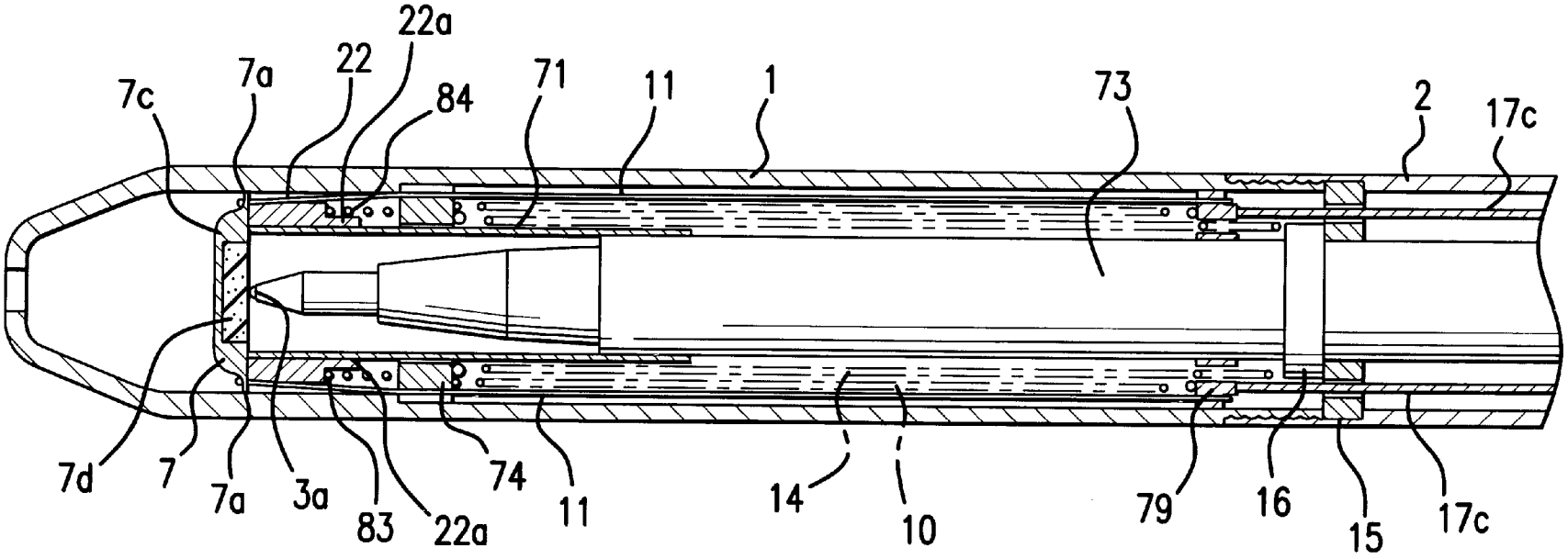
FIG. 14 is a sectional view showing the front end writing portion released from the seal provided by the seal cover.
Figure 15:
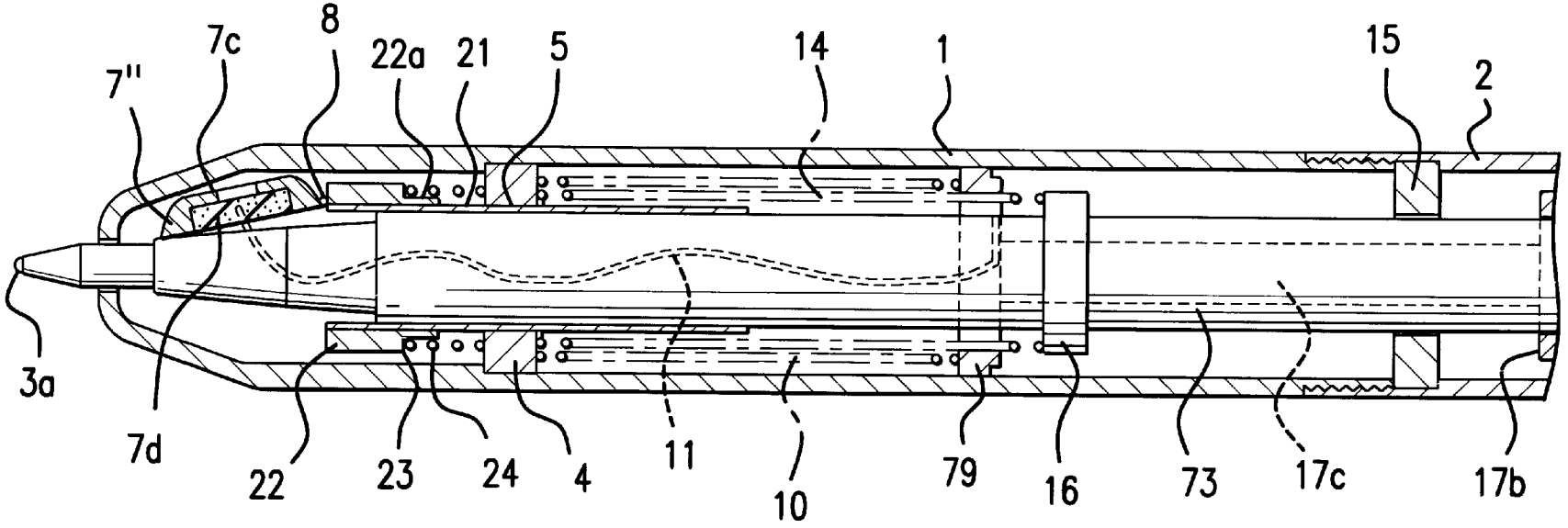
FIG. 15 is a partial side sectional view showing the projecting state of the front end writing portion of the writing body.

And when the advancing and retracting mechanism is operated for advancing movement in order to establish the writing state, the slide ring 79 is pushed by the rod 17*c* of the pushing member to make a forward movement, and as soon as this movement slackens the string-like member 11, the guide sleeve 75 is moved forward by the urging force of the separating spring 84 prior to the movement of the writing body 3 until the ridge 85 comes in locking engagement with the locking ring 74, so that the seal cover 7" either lightly contact the front end writing portion 3*a* as shown in FIG. 14 or is very slightly separated therefrom. Thereafter, the forward movement of the pushing member 17 causes the writing body 3 and slide ring 79 to advance, slackening the string-like member 11 and opening the seal cover 7" under the urging force directed in the opening direction. As the string-like member 11 further slacks, the writing body 73 advances until the front end writing portion 3*a* projects through the hole in the front end of the front shaft 1, to be ready for writing.

Figure 16A:
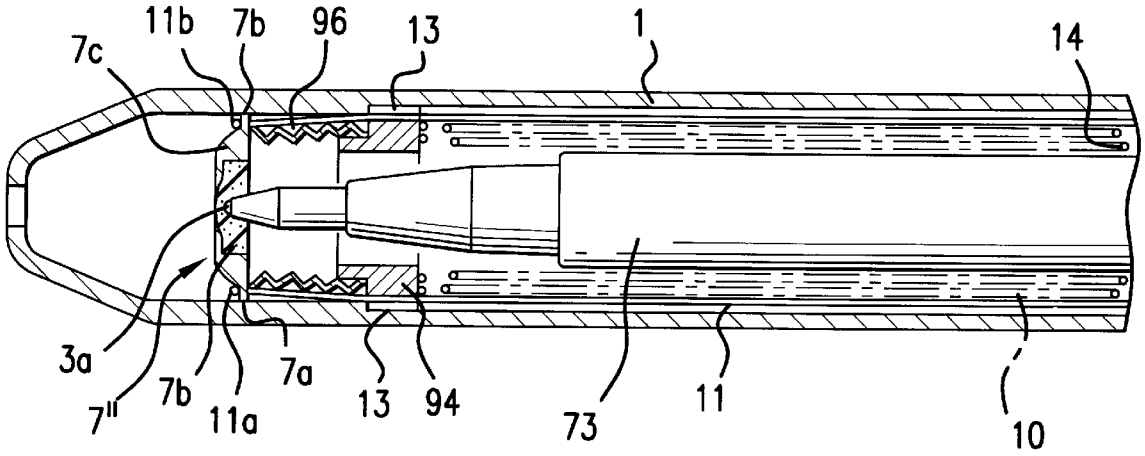
FIGS. 16(*a*) and 16(*b*) show a different embodiment of a separating spring. Wherein FIG. 16(*a*) is a sectional view showing the sealed state of the front end writing portion and FIG. 16(*b*) is a side sectional view showing the seal being cancelled.
Figure 16B:
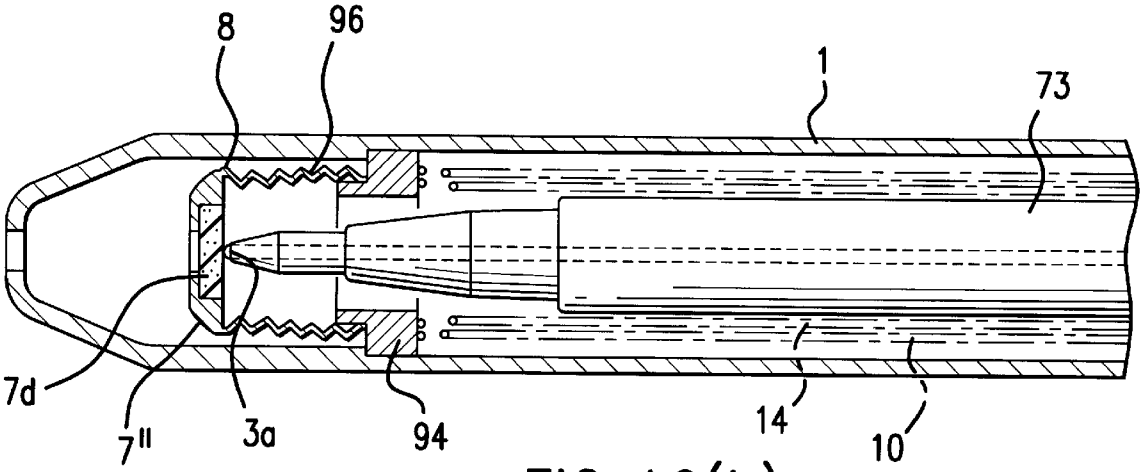

FIG. 16 shows an embodiment employing a rubber sleeve in the form of a bellows instead of a separating spring, (a) showing the sealed state of the front end writing portion 3*a,* (*b*) showing unsealed state thereof.

The rear portion of the rubber sleeve 96 is attached to a front smaller diameter portion of a locking ring 94, and the seal cover 7" is integrally attached to a front end of the rubber sleeve 94 through the hinge portion 8.

This arrangement reduces the number of parts and facilitates assembly.

The function is the same as in the preceding embodiment wherein when the writing body 73 is to be stored, it is retracted by the elastic force of the retracting spring 14 through the operation of the advancing and retracting mechanism and so is the slide ring 79 by the pulling spring 10.

In this case, since the elastic force of the retracting spring 14 is equal to or somewhat stronger than that of the pulling spring 10, the writing body 73 is retracted substantially at the same time as or somewhat earlier than the slide ring 79; therefore, when the retraction of the slide ring 79 results in the string-like member 11 being tightened to pull the seal cover 7" into the closed state, the writing body 73 is in a considerably retracted position, so that the seal cover 7" can be closed without interference. Further, after it has been closed, the guide sleeve 75 is pulled by the slide ring 79 which is retracted by the urging force of the pulling spring 10 and it is moved in the retracting direction against the urging force of the separating spring 84, so that the inner surface of the seal cover 7 elastically closely contacts the front end writing portion 3*a* of the writing body 73 placed in the storage position; thus, it is held in the predetermined closely contacted state.

In addition in each of the above embodiments, shock absorbing means may be provided in order to mitigate the shock upon retraction of the writing body.

According to the capless writing tool of the invention, the drying, leakage and backflow of the ink can be effectively prevented.

Further, in the capless writing tool of the invention, damage to the front end writing portion due to rubbing between the front end writing portion and the seal cover is prevented.

As described above, according to the capless writing tool of the invention, in the stored state of the writing body, the clearance between the writing ball of the front end writing portion and the embracing portion therearound can be reliably held in the sealed state, so that the drying, leakage and backflow of the ink can be reliably prevented and the knocking operation by the advancing and retracting of the writing body can be easily effected without any trouble.

Furthermore, since there is no portion which is sealed other than the clearance between the ball of the front end writing portion and the embracing portion therearound, there is no possibility of increasing the inner pressure in the cap before the front end writing portion is sealed by the seal cover of elastic material, and hence there is no possibility of producing a difference in pressure between the inside and outside of the writing body, nor is the danger of the air flowing into the writing body. Further, since there is no seal portion which closely contacts the outer periphery of the writing body, there is no resistance to the advancing and retracting movements of the writing body and hence the spring for retracting the writing body need not have a large elastic force.

Therefore, this writing tool is well applicable to a neutral ink ballpoint pen wherein the rear end of the writing body is opened to charge a fluid sealant in the ink terminal. This writing tool is simple in construction, easy to assemble and can be produced at low cost.

According to the capless writing tool of the invention, since there is no need to mount and dismount a cap, the usage is simple and convenient, and in the stored state of the writing body, since the clearance between the writing ball of the front end writing portion and the embracing portion therearound can be reliably held in the sealed state through direct close contact with the seal cover, the drying, leakage and backflow of the ink can be reliably prevented. And during the advance of the writing body, first, the sealed state of the front end writing portion established by the seal cover is cancelled, and then the seal cover opens at the same time as the front end writing portion advances; thus, there is no possibility of the front end writing portion damaging the elastic material of the seal cover.

Furthermore, since there is no portion which is sealed other than the clearance between the ball of the front end writing portion and the embracing portion therearound, there is no possibility of increasing the inner pressure in the cap as in the case of the cap type when the front end writing portion is sealed by the seal cover of elastic material, and hence there is no danger of the air flowing into the writing body. Further, since there is no seal portion which closely contacts the outer periphery of the writing body, there is no resistance to the advancing and retracting movements of the writing body and hence the spring for retracting the writing body need not have a large elastic force.

Particularly, in the operation of storing the writing body, in the case of one embodiment of the invention, since the action of the slide ring to positively push the writing body is also concurrently performed, or in the case of another embodiment of the invention, since the elastic force of the retracting spring is equal to or greater than that of the pulling spring which urges the slide ring rearward, in each case there is no delay in the returning of the writing body and hence there is no possibility of the closing action of the seal cover being obstructed.

Therefore, the present invention is well applicable to a neutral ink ballpoint pen wherein the rear end of the writing boy is opened to charge a fluid sealant in the ink terminal. And, the inventive article is simple in construction and easy to assemble and can be produced at low cost.

What is claimed is:

1. A capless writing tool comprising:

a tubular body having a hole in a front end thereof;

a writing body stored in said tubular body and having a front portion with a front end writing portion passable through said hole during respective closing and opening operations;

a sleeve, having an open end, disposed in a front portion of said tubular body and through which at least said front portion of said writing body passes;

a cover for covering said open end of said sleeve through which said front portion of said writing body passes, said cover being movable between an opened state and a closed state;

cover moving means for closing and holding said cover in said closed state, covering said open end, and opening said cover to said opened state; and means for maintaining said cover in a sealed state such that the front end writing portion of said writing body is elastically embeddedly contacting said cover when the cover is in the closed state and is sealed thereby.

2. The capless writing tool as set forth in claim 1, further comprising means for relatively advancing said sleeve with respect to said writing body during said opening operation such that said front end writing portion is not in close contact with said cover prior to said cover moving means opening said cover to said opened state.

3. The capless writing tool as set forth in claim 1 or 2, further comprising means for retracting said writing body with respect to said sleeve during said closing operation such that said front end writing portion is not in close contact with said cover when said cover moving means begins closing said cover to said closed state.

4. A capless writing tool comprising:

a writing body having a front end portion with a front end writing portion embracing a writing ball:

a tubular body having a hole through which said front end portion of said writing body passes in and out, the writing body being slidably received in said tubular body;

a guide sleeve disposed in a front portion of said tubular body through which said writing body is slidably received and passes;

a seal cover made of elastic material at least at an inner surface thereof for contacting said front end writing portion;

said seal cover being openably and closeably installed at a front end of said guide sleeve and movable between an opened state and a closed state;

an advancing and retracting mechanism for advancing the writing body to a writing state and retracting the writing body to a stored state; and cover moving means which, when the writing body is stored in said stored state by said advancing and retracting mechanism, pulls said seal cover to said closed state and which, when the writing body is advanced, lessens the pulling to cancel the closed state of the seal cover, said seal cover in the closed state being elastically closely contacted with the front end writing portion of the writing body to the extent of filling a clearance between the writing ball and the ball embracing portion therearound so as to maintain a sealed state.

5. The capless writing tool as set forth in claim 4, wherein:

the guide sleeve is axially slidable within said tubular body but is prevented from advancing beyond a given limit; and said cover closing means includes a slide ring slidably disposed in said tubular body reward of said guide sleeve and rearwardly biased by a spring and a slackable string-like member serving as pulling means connecting the seal cover and said slide ring such that when the writing body is advanced by the advancing and retracting mechanism, the advancing and retracting mechanism advances the guide sleeve, together with the slide ring, to cancel the sealed state of the front end writing portion established by the seal cover, and then the pulling means slackens with the advance of the writing body and slide ring, thereby opening the seal cover.

6. A capless writing tool comprising:

a writing body having a front end portion with a front end writing portion embracing a writing ball:

a tubular body having a hole through which said front end portion of said writing body passes in and out, the writing body being slidably received in said tubular body;

a retracting spring for retracting said writing body rearwardly into said tubular body;

an advancing and retracting mechanism for advancing the writing body against a biasing force of said retracting spring so as to hold said writing body in a writing state and so as to allow said writing body to be retracted by said retracting spring to a retracted state for storage;

a guide sleeve with an open front end installed in a front portion of the tubular body and through which said front end portion of said writing body slidably passes;

said guide sleeve being axially slidable within said tubular body and having restricting means for preventing said guide sleeve from advancing beyond a predetermined limit;

a seal cover hinged at said open front end of the guide sleeve and movable between an opened state and a closed state for closing said open front end, said seal cover being made of elastic material at least at an inner surface thereof for contacting said front end writing portion, and said seal cover being biased in an opening direction;

a slide ring slidably received in said tubular body rearward of said guide sleeve and a pulling spring rearwardly biasing said slide ring;

said advancing and retracting mechanism including means for advancing said slide ring prior to advancing the writing body; and a slackable string member connecting said slide ring and said seal cover to pull the seal cover to a closed position when the writing body is stored such that said seal cover is moved to be elastically closely contacting the front end writing portion of the writing body to the extent of filling a clearance between the writing ball and the ball embracing portion therearound so as to maintain a sealed state, and such that when the writing body is to be advanced, the guide sleeve, together with the slide ring, advances to cancel the sealed state of the front end writing portion established by the seal cover and then the string member slackens with further advance of the slide ring, allowing the seal cover to assume the opened state permitting subsequent advancement of the writing body to a position extending through said hole of said tubular body to said writing state.

7. The capless writing tool as set forth in claim 6, wherein:

said writing body extends through said slide ring; and said writing body has boss disposed on a periphery thereof rearward of said slide ring and engagable by the slide ring such that when said slide ring and said writing body are in said retracted state for storage there is clearance between said boss and a rear surface of the slide ring.

8. A capless writing tool comprising:

a writing body having a front end portion with a front end writing portion embracing a writing ball;

a tubular body having a hole through which said front end portion of said writing body passes in and out, the writing body being slidably received in said tubular body;

a retracting spring for retracting said writing body rearwardly into said tubular body:

an advancing and retracting mechanism for advancing the writing body against a biasing force of said retracting spring so as to hold said writing body in a writing state and so as to allow said writing body to be retracted by said retracting spring to a retracted state for storage;

a guide sleeve with an open front end installed in a front portion of the tubular body and through which said front end portion of said writing body slidably passes;

said guide sleeve being axially slidable within said tubular body and having restricting means for preventing said guide sleeve from advancing beyond a predetermined limit;

a seal cover hinged at said open front end of the guide sleeve and movable between an opened state and a closed state for closing said open front end, said seal cover being made of elastic material at least at an inner surface thereof for contacting said front end writing portion, and said seal cover being biased in an opening direction;

a slide ring slidably received in said tubular body rearward of said guide sleeve and a pulling spring rearwardly biasing said slide ring;

said advancing and retracting mechanism including means for advancing said slide ring prior to advancing the writing body;

a slackable string member connecting said slide ring and said seal cover to pull the seal cover to a closed position when the writing body is stored such that said seal cover is moved to be elastically contacting the front end writing portion of the writing body to the extent of filling a clearance between the writing ball and the ball embracing portion therearound so as to maintain a sealed state of said writing body, and such that when the writing body is to be advanced, the guide sleeve, together with the slide ring, advances to cancel the sealed state of the front end writing portion established by the seal cover and then the string member slackens with further advance of the slide ring, allowing the seal cover to assume the opened state permitting subsequent advancement of the writing body to a position extending through said hole of said tubular body to said writing state;

an elastic force of said retracting spring being equal to or greater than that of the pulling spring; and bias means for biasing the guide sleeve in the advancing direction by an elastic force which is lower than the elastic force of each of said retracting spring and said pulling spring.

9. The capless writing tool as set forth in claim 8, wherein the bias means for biasing the guide sleeve in the advancing direction is a separating spring whose elastic force is much less than that of each of the retracting spring and said pulling spring.

10. The capless writing tool as set forth in claim 8, wherein the bias means for biasing the guide sleeve in the advancing direction is a rubber sleeve in the form of a bellows forming a body of said guide sleeve.

11. The capless writing tool as set forth in claim 6 or 8, wherein the restricting means of the guide sleeve includes:

a locking ring fixedly disposed in said tubular body with said guide sleeve slidably received therein;

said guide sleeve having a first stop which is located rearwardly of said locking ring and which abuts against a rear end surface of said locking ring to arrest advancement of said guide sleeve; and said guide sleeve having a second stop located forwardly of the locking ring and which abuts against a front end surface of said locking ring to arrest retraction of said guide sleeve.

12. A writing instrument comprising:

a tubular body having a front and rear end with a front end hole in said front end;

a writing cartridge slidably disposed in said tubular body, said writing cartridge having a writing tip through which ink is emitted;

a positioning mechanism for forwardly advancing said writing cartridge in said tubular body to a writing position whereat said writing tip extends out of said tubular body through said front end hole and for rearwardly retracting said writing cartridge to a storage position whereat said writing tip is within said tubular body;

a seal cover having a deformable elastic portion at an inner surface thereof;

said seal cover being hinged within said tubular body proximate said writing tip when said writing cartridge is at said storage position, said seal cover being pivotable between an opened position whereat said writing cartridge is advanceable to said writing position and a closed position whereat said seal cover is engageable with said writing tip when said writing cartridge is in said stored position; and a pivoting mechanism for pivoting said seal cover to said open position when said positioning mechanism is operated to advance said writing cartridge to said writing position and for pivoting said seal cover to said closed position to engage said writing tip with sufficient pressure such that said elastic portion deforms over said writing tip to seal said writing tip thereby preventing drying of ink at said writing tip.

13. The writing instrument according to claim 12 wherein said pivoting mechanism further includes means for releasing said sufficient pressure on said seal cover prior to forward advancement of said writing cartridge.

14. The writing instrument according to claim 12 wherein said pivoting mechanism further includes means for applying said sufficient pressure to said seal cover after said writing cartridge is retracted to said storage position.

15. The writing instrument according to claim 12 wherein said pivoting mechanism further includes means for releasing said sufficient pressure on said seal cover prior to forward advancement of said writing cartridge and for applying said sufficient pressure to said seal cover after said writing cartridge is retracted to said storage position.

16. The writing instrument according to claim 15 further comprising:

a cover mount member upon which said seal cover is hinged permitting axial displacement of said seal cover; and cover mount biasing means for forwardly biasing said seal cover to forwardly advance of said seal cover prior to forward advancement of said writing cartridge.

17. The writing instrument according to claim 15 wherein said pivoting mechanism includes:

a slide ring slidably disposed in said tubular body rearward of said seal cover;

a slide ring bias means for rearwardly biasing said slide ring;

a connecting member connecting said slide ring to said seal cover to pivot said seal cover in accordance with displacement of said slide ring; and a slide ring pushing member for advancing said slide ring in response to advancing operation of said positioning mechanism, said slide ring pushing member engaging said slide ring with said positioning mechanism, prior to said positioning mechanism engaging said writing cartridge, for advancing said slide ring prior to advancing said writing cartridge and for retracting said writing cartridge to said storage position prior to said slide ring pivoting said seal cover to apply said sufficient pressure.

18. The writing instrument according to claim 17 wherein said seal cover is biased in an opening direction and said connecting member is a slackable string member.

19. The writing instrument according to claim 17 further comprising:

a cover mount member upon which said seal cover is hinged permitting axial displacement of said seal cover in said tubular body; and cover mount biasing means for forwardly biasing said seal cover to forwardly advance said seal cover prior to forward advancement of said writing cartridge.

20. The writing instrument according to claim 19 wherein:

said positioning mechanism includes a retracting bias spring for rearwardly biasing said writing member and a restriction means for limiting retraction of said writing cartridge, by said retracting bias spring, to said storage position;

said retracting bias spring simultaneously functions as said cover mount biasing means to forwardly bias said seal cover; and said slide ring biasing means has greater elastic force than said retracting bias spring.

21. The writing instrument according to claim 19 wherein said cover mount biasing means comprises said cover mount member being made of an elastic material.

22. The writing instrument according to claim 19 wherein said cover mount member is slidably disposed in said tubular body and said cover mount biasing means is a spring forwardly biasing said cover mount member upon which said seal cover is hinged.

23. A writing instrument comprising:

a tubular body having a front and rear end with a front end hole in said front end;

a writing cartridge slidably disposed in said tubular body, said writing cartridge having a writing tip through which ink is emitted;

a positioning mechanism for forwardly advancing said writing cartridge in said tubular body to a writing position whereat said writing tip extends out of said tubular body through said front end hole and for rearwardly retracting said writing cartridge to a storage position whereat said writing tip is within said tubular body;

a seal cover having a deformable elastic portion at an inner surface thereof;

said seal cover being hinged within said tubular body proximate said writing tip when said writing cartridge is at said storage position, said seal cover being pivotable between an opened position whereat said writing cartridge is advanceable to said writing position and a closed position whereat said seal cover is engageable with said writing tip when said writing cartridge is in said stored position;

a cover mount member upon which said seal cover is hinged permitting axial displacement of said seal cover in said tubular body;

a pivoting mechanism for pivoting said seal cover to said open position when said positioning mechanism is operated to advance said writing cartridge to said writing position and for pivoting said seal cover to said closed position to engage said writing tip with sufficient pressure such that said elastic portion deforms over said writing tip to seal said writing tip thereby preventing drying of ink at said writing tip;

said pivoting mechanism including:

a slide ring slidably disposed in said tubular body rearward of said seal cover;

a slide ring bias means for rearwardly biasing said slide ring;

a connecting member connecting said slide ring to said seal cover to pivot said seal cover in accordance with displacement of said slide ring; and a slide ring pushing member for advancing said slide ring in response to advancing operation of said positioning mechanism, said slide ring pushing member engaging said slide ring with said positioning mechanism, prior to said positioning mechanism engaging said writing cartridge, for advancing said slide ring prior to advancing said writing cartridge and for retracting said writing cartridge to said storage position prior to said slide ring pivoting said seal cover to apply said sufficient pressure such that said pivoting mechanism releases said sufficient pressure on said seal cover prior to forward advancement of said writing cartridge and applies said sufficient pressure to said seal cover after said writing cartridge is retracted to said storage position;

cover mount biasing means for forwardly biasing said seal cover to forwardly advance said seal cover prior to forward advancement of said writing cartridge in response to advancement of said slide ring;

said positioning mechanism including a retracting bias spring for rearwardly biasing said writing member and a restriction means for limiting retraction of said writing cartridge by said retracting bias spring to said storage position;

said retracting bias spring simultaneously functioning as said cover mount biasing means to forwardly bias said seal cover; and said slide ring biasing means has greater elastic force than said retracting bias spring.

* * * * *